US007928854B2

(12) United States Patent
Martino

(10) Patent No.: US 7,928,854 B2
(45) Date of Patent: Apr. 19, 2011

(54) TECHNIQUES FOR SMOKE DETECTION

(76) Inventor: Gary Martino, Oxford, CT (US)

( * ) Notice: Subject to any disclaimer, the term of this patent is extended or adjusted under 35 U.S.C. 154(b) by 389 days.

(21) Appl. No.: 11/687,067

(22) Filed: Mar. 16, 2007

(65) Prior Publication Data

US 2007/0229293 A1 Oct. 4, 2007

Related U.S. Application Data

(60) Provisional application No. 60/784,023, filed on Mar. 20, 2006, provisional application No. 60/801,445, filed on May 18, 2006.

(51) Int. Cl.
*G08B 17/10* (2006.01)

(52) U.S. Cl. ..... 340/628; 340/630; 340/555; 340/556; 340/557; 250/573; 702/183

(58) Field of Classification Search ..... 340/630, 340/693.9, 693.11, 511, 555–557, 628; 250/573
See application file for complete search history.

(56) References Cited

U.S. PATENT DOCUMENTS

| | | | | | |
|---|---|---|---|---|---|
| 4,171,944 | A * | 10/1979 | Hirschmann | 431/22 |
| 4,189,296 | A * | 2/1980 | Hayes | 431/20 |
| 4,267,965 | A * | 5/1981 | Everett | 236/1 G |
| 4,792,797 | A * | 12/1988 | Tanguay et al. | 340/628 |
| 5,239,980 | A | 8/1993 | Hilt et al. | |
| 5,673,027 | A * | 9/1997 | Morita | 340/630 |
| 5,721,430 | A | 2/1998 | Wong | |
| 5,850,739 | A * | 12/1998 | Masnoi | 60/653 |
| 6,175,676 | B1 * | 1/2001 | Sharan | 385/100 |
| 6,178,734 | B1 * | 1/2001 | Shibuya et al. | 60/772 |
| 6,259,081 | B1 * | 7/2001 | Gross et al. | 250/205 |
| 6,338,241 | B1 * | 1/2002 | Shibuya et al. | 60/39.182 |
| 6,565,352 | B2 * | 5/2003 | Nielsen et al. | 431/13 |
| 6,672,255 | B1 | 1/2004 | Zayas | |
| 6,774,802 | B2 | 8/2004 | Bachinski et al. | |
| 6,779,735 | B1 | 8/2004 | Onstott | |
| 6,979,260 | B2 | 12/2005 | Liu | |
| 6,989,757 | B2 | 1/2006 | Geoffrey et al. | |
| 2005/0195078 | A1 * | 9/2005 | Basinger et al. | 340/521 |
| 2006/0202123 | A1 * | 9/2006 | Vuillermoz et al. | 250/343 |
| 2006/0234621 | A1 * | 10/2006 | Desrochers et al. | 454/239 |
| 2010/0006792 | A1 * | 1/2010 | Shindo et al. | 251/359 |

* cited by examiner

*Primary Examiner* — Daniel Wu
*Assistant Examiner* — Ryan W Sherwin
(74) *Attorney, Agent, or Firm* — Michael J. Chang, LLC

(57) ABSTRACT

Techniques for smoke detection are provided. In one aspect, an exemplary smoke detection device is provided. The smoke detection device comprises an infrared beam transmitting unit; an infrared beam receiving unit; and a control module associated with the infrared beam transmitting unit and the infrared beam receiving unit. The infrared beam transmitting unit and the infrared beam receiving unit are configured to communicate with each other, via an infrared beam, and with the control module, via a signal produced in response to smoke being present at a level that is greater than a threshold smoke level.

6 Claims, 15 Drawing Sheets

TECHNIQUES FOR SMOKE DETECTION

CROSS REFERENCE TO RELATED APPLICATIONS

This application claims the benefit of U.S. Provisional Application Nos. 60/784,023, filed Mar. 20, 2006, and 60/801,445, filed May 18, 2006, the disclosures of which are incorporated by reference herein.

FIELD OF THE INVENTION

The present invention relates to smoke detection, and more particularly, to smoke detection in furnace and ventilation systems.

BACKGROUND OF THE INVENTION

A malfunctioning burner in an oil-fired heating device, such as an oil-fired furnace, can lead to inefficient and unsafe conditions. For example, a burner receiving an incorrect air/fuel mixture can result in improper combustion, causing a high level of smoke (soot) to be generated during operation. Over time, the soot builds up in the furnace system, clogging the heat exchange passageways. Clogged heat exchange passageways result in the furnace having to be operated for a longer period of time and/or at a higher temperature for adequate heating, which is inefficient. Expensive and time-consuming maintenance must then be performed to remove the soot build-up. Further, in some instances, the soot produced will exit the furnace system and be dispersed throughout a home. The damage can be quite extensive and extremely costly to clean up.

Soot build-up in the furnace system can also limit the oxygen supply to the burner. This leads to incomplete combustion of the oil and, as a result, the production of carbon monoxide gas. Carbon monoxide gas is a serious safety concern.

Techniques have been devised to detect smoke being produced by a furnace and, upon detection of smoke, turn off the furnace. See, for example, U.S. Pat. No. 4,171,944 issued to Hirschmann, entitled "Combined Smoke Detection and Furnace Shut Off Device" (hereinafter "Hirschmann"). In Hirschmann, a smoke detector is placed in a room near the furnace. In the event that smoke is detected in the room, the smoke detector causes ignition within the furnace to be stopped. While the device in Hirschmann may be applicable to extreme smoke conditions, such as when there is a furnace fire, the device would not function to detect the level of smoke produced by a malfunctioning burner. Specifically, since the detector in Hirschmann is external to the furnace system, the smoke from a malfunctioning burner would likely not even be detected.

In U.S. Pat. No. 2,727,203 issued to Zeitlin et al., entitled "Smoke Detector and Blower Motor Control System" (hereinafter "Zeitlin"), a light source, namely a light bulb, and a photo-cell are placed in a chimney to detect smoke. When smoke is detected, a burner shut-off mechanism is activated. The device described in Zeitlin, however, would not provide the level of sensitivity needed to detect smoke produced by a malfunctioning burner. Further, furnaces of different designs and of different ages, during normal operations, produce different acceptable amounts of smoke. The device described in Zeitlin would not accommodate those variations.

Thus, there exists a need for improved techniques to prevent excessive smoke conditions within systems, such as a furnace system.

SUMMARY OF THE INVENTION

Techniques for smoke detection are provided. In one aspect of the invention, an exemplary smoke detection device is provided. The smoke detection device comprises an infrared beam transmitting unit; an infrared beam receiving unit; and a control module associated with the infrared beam transmitting unit and the infrared beam receiving unit. The infrared beam transmitting unit and the infrared beam receiving unit are configured to communicate with each other, via an infrared beam, and with the control module, via a signal produced in response to smoke being present at a level that is greater than a threshold smoke level.

In another aspect of the invention, a ventilation system is provided. The ventilation system comprises one or more of a heating unit, an air conditioning unit and an air distribution fan; and one or more smoke detection devices. The one or more smoke detection devices comprise an infrared beam transmitting unit; an infrared beam receiving unit; and a control module associated with the infrared beam transmitting unit and the infrared beam receiving unit. The infrared beam transmitting unit and the infrared beam receiving unit are configured to communicate with each other, via an infrared beam, and with the control module, via a signal produced in response to smoke being present at a level that is greater than a threshold smoke level.

For example, the heating unit may comprise a furnace system having a furnace with a burner and a flue positioned to vent smoke from the burner. At least one of the one or more smoke detection devices may be associated with the flue and configured to turn off the burner in response to smoke being present in the flue at a level that is greater than the threshold smoke level.

In yet another aspect of the invention, a method for smoke detection in a furnace system is provided. The furnace system has a furnace with a burner, a flue positioned to vent smoke from the burner and at least one smoke detection device associated with the flue. The at least one smoke detection device comprises an infrared beam transmitting unit; an infrared beam receiving unit; and a control module associated with the infrared beam transmitting unit and the infrared beam receiving unit. The infrared beam transmitting unit and the infrared beam receiving unit are configured to communicate with each other, via an infrared beam at least a portion of which passes through the flue, and with the control module, via a signal. The method comprises the steps of, generating the signal in response to at least one break in the infrared beam; sending the signal to the control module; and upon receipt of the signal by the control module, using the control module to turn off the burner.

In still another aspect of the invention, a method for smoke detection in a ventilation system is provided. The ventilation system has one or more of an air conditioning unit, a heating unit, an air distribution fan and a duct connecting one or more of the air conditioning unit, the heating unit and the air distribution fan, and at least one smoke detection device associated with the duct. The at least one smoke detection device comprises an infrared beam transmitting unit; an infrared beam receiving unit; and a control module associated with the infrared beam transmitting unit and the infrared beam receiving unit. The infrared beam transmitting unit and the infrared beam receiving unit are configured to communicate with each other, via an infrared beam at least a portion of which passes through the duct, and with the control module, via a signal. The method comprises the steps of, generating the signal in response to at least one break in the infrared beam; sending the signal to the control module; and upon receipt of the signal by the control module, using the control module to turn off the air conditioning unit, the heating unit and the air distribution fan.

A more complete understanding of the present invention, as well as further features and advantages of the present invention, will be obtained by reference to the following detailed description and drawings.

DETAILED DESCRIPTION OF PREFERRED EMBODIMENTS

Figure 1:
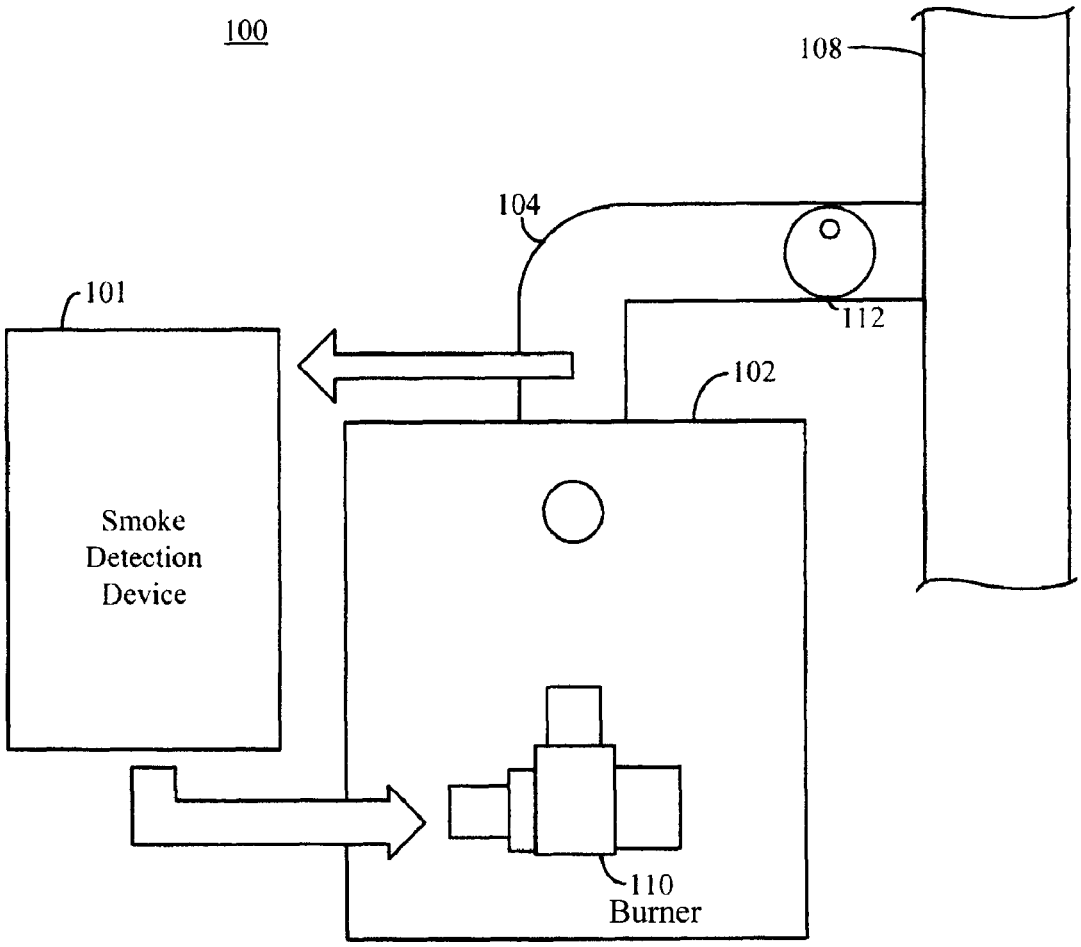
FIG. 1 is a diagram illustrating an exemplary furnace system having a smoke detection device associated therewith according to an embodiment of the present invention.

Referring to the following description, wherein like components are numbered alike, FIG. 1 is a diagram illustrating exemplary furnace system 100 having smoke detection device 101 associated therewith. Furnace system 100 comprises furnace 102, flue 104, and chimney 108.

Furnace 102 contains burner 110. Burner 110 is an oil burner. As is common with burners in an oil-fired furnace, burner 110 is ignited by an electrical ignition mechanism that obtains its power from a power source. As such, burner 110 can be switched on or off by connecting or disconnecting the electrical ignition mechanism from the power source. Switching burner 110 on or off will be described in further detail below.

Flue 104 serves to vent gases generated by burner 110 out through chimney 108. Flue 104 contains barometric damper 112. Barometric damper 112 is attached to the inside of flue 104 and serves to open flue 104 when a draft in chimney 108 increases. When flue 104 is opened, infiltration air is permitted into furnace system 100 and the rate at which the flue gases exit through chimney 108 is decreased. As a result, furnace stack temperatures are kept low and burner efficiency is increased. Without barometric damper 112, heating efficiency would drop, as too much usable heat would exit through chimney 108.

According to the present teachings, smoke detection device 101 is associated with furnace system 100. Namely, as shown in FIG. 1 and as will be described in detail below, smoke detection device 101 can be employed to sense furnace gasses present in flue 104 and is configured to switch burner 110 off in response to a high smoke condition, e.g., greater than a predetermined threshold level of smoke present, within flue 104.

In preferred embodiments of the present invention, as will be described in detail below, smoke detection device 101 is an infrared smoke detection device employing an infrared beam, at least a portion of which passes through flue 104. High smoke conditions in flue 104 cause a break(s) in the infrared beam, which can then trigger the infrared smoke detection device to turn off burner 110. Since smoke detection device 101 is associated with a furnace system, smoke detection device 101 may also be referred to herein as a furnace smoke detection device.

Figure 2:
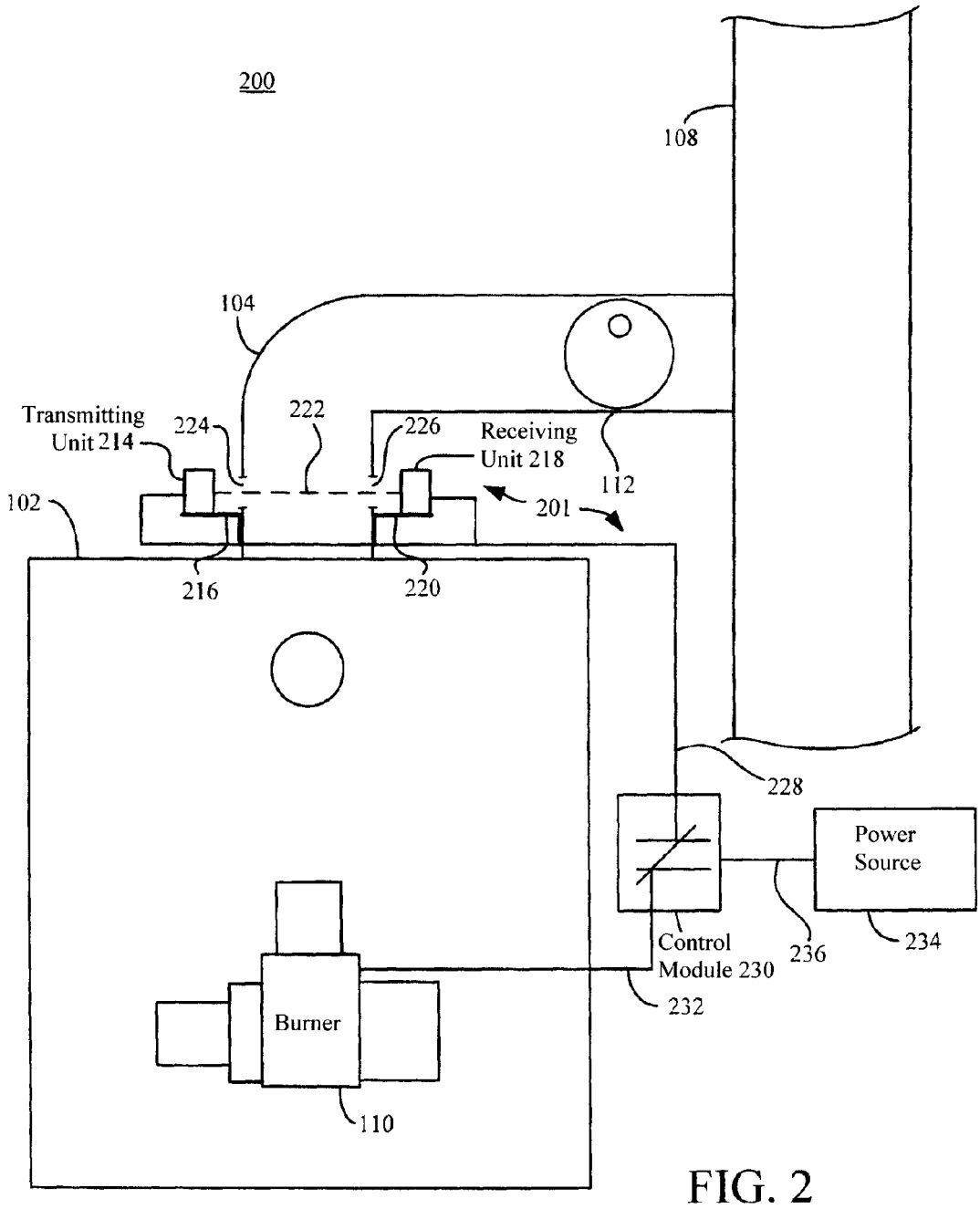
FIG. 2 is a diagram illustrating one possible configuration of the smoke detection device of FIG. 1 according to an embodiment of the present invention.

FIG. 2 is a diagram illustrating exemplary smoke detection device 201. Smoke detection device 201 is one possible configuration of smoke detection device 101 described in conjunction with the description of FIG. 1, above. As described above, smoke detection device 201, being associated with a furnace system, may also be referred to herein as a furnace smoke detection device.

Smoke detection device 201 comprises an infrared transmitter, i.e., infrared beam transmitting unit 214 (affixed to flue 104 by bracket 216), an infrared receiver, i.e., infrared beam receiving unit 218 (affixed to flue 104 by bracket 220) and a control module, i.e., control module 230. As will be described in detail below, at least one function of control module 230 is to act as a switch connecting or disconnecting burner 110 from an electrical power source.

Burner 110 is ignited by an electrical ignition mechanism connected to electrical power source 234. In FIG. 2, it is shown that power source 234, e.g., power source to a building/dwelling, is connected to burner 110 through control module 230, i.e., via electrical conduits 232 and 236. As such, burner 110 can be switched on or off by connecting or disconnecting the electrical ignition mechanism from power source 234.

Infrared beam transmitting unit 214 produces infrared beam 222 that passes through flue 104 via portals 224 and 226 and is received by infrared beam receiving unit 218. Thus, infrared beam transmitting unit 214 communicates with infrared beam receiving unit 218 via infrared beam 222. Namely, if infrared beam 222 is broken, for example, by a high level of smoke passing through flue 104, infrared beam transmitting unit 214 and/or infrared beam receiving unit 218 will send a signal through electrical conduit 228 to control module 230 indicating a high smoke condition. The term "electrical conduit," as used herein, is intended to refer to any suitable electrical carrier(s), including, but not limited to, one or more insulated copper wires.

According to an exemplary embodiment, the signal, an electrical signal, is sent by infrared beam receiving unit 218 such that when infrared beam 222 is broken, infrared beam receiving unit 218 gives power source output (the signal) to control module 230, e.g., a relay switch, to activate control module 230. Control module 230, when activated, will then disconnect the electrical ignition mechanism from power source 234, thus effectively turning off burner 110. For example, control module 230 can comprise a relay switch that, without power source output, provides a closed electrical circuit from power source 234 to the electrical ignition mechanism. However, when power source output is provided to control module 230, control module 230 opens, e.g., opening the electrical circuit between power source 234 and the electrical ignition mechanism.

While FIG. 2 shows control module 230 controlling one component of furnace system 200, i.e., burner 110, control module 230 may be used to control a plurality of components. By way of example only, in FIG. 13 (described below) control module 230 is employed to control multiple components in a ventilation system.

Smoke detection device 201 is associated with, i.e., senses gasses at, a portion of flue 104 that is between furnace 102 and barometric damper 112, as shown in FIG. 2. This placement ensures that sensing is being conducted of furnace gasses that have not yet been diluted by incoming air from chimney 108. As such, more accurate smoke readings will be obtained.

Further, control module 230 can be configured such that when a signal is sent to control module 230 from infrared beam transmitting unit 214 and/or infrared beam receiving unit 218, control module 230 activates an alarm system. For example, control module 230 can be connected to an existing home/building alarm system. Many conventional home/building alarm systems are set up to automatically send an alert to authorities, e.g., police and fire department, as well as, to the home/building owner, when the alarm is activated. When the present smoke detection device is integrated into the alarm system, an alert can also be sent to the furnace service company.

Smoke in flue 104 can be caused by any one of a number of irregular conditions. These conditions include, but are not limited to, a defective combustion chamber (refractory), a lack of combustion air, a soot-laden retention head, a clogged or defective chimney, a defective pump cut-off, excessive condensation or a leak in the boiler and a cracked or defective heat exchanger in warm air furnace.

Smoke detection device 201 can receive its operating power through electrical conduit 228, i.e., a powered connection. By way of example only, smoke detection device 201 can be adapted to receive power via electrical conduit 228, as either 12 volts of direct current or 24 volts of alternating current, depending on the output of power source 234. The smoke detection device should be powered continuously, regardless of whether burner 110 is on or off (for example, wherein electrical conduit 228 is a dedicated powered connection). This will provide protection, for example, at the time of burner shut-off and will serve to detect smoke, i.e., in the case of a faulty pump cut-off device. Control module 230 is powered through safety devices commonly found in standard equipment, such as load cell relays.

Figure 6:
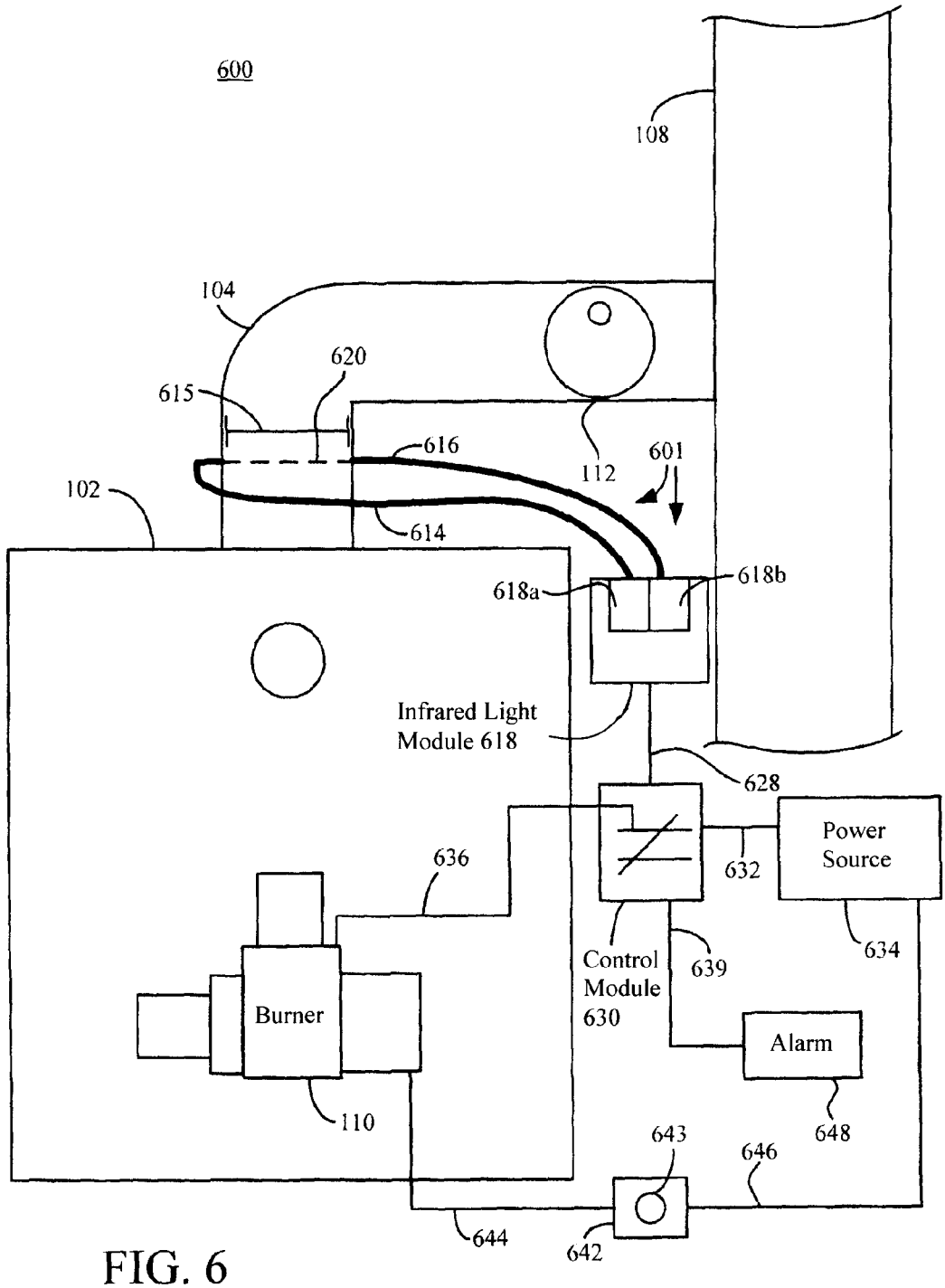
FIG. 6 is a diagram illustrating another possible configuration of the smoke detection device of FIG. 1 according to an embodiment of the present invention.

An optional bypass (not shown) of control module 230 can be incorporated in furnace system 200. Specifically, the bypass can allow for burner 110 to remain on, even when smoke is detected by the smoke detection device and a signal is sent to control module 230 to turn off burner 110. The bypass can act as a temporary connection between burner 110 and power source 234. An exemplary bypass that may be employed in furnace system 200 is shown in FIG. 6 and is described below.

Such a bypass is useful during servicing of furnace system 200, when large amounts of smoke are knowingly generated. For example, if no ignition has taken place, residual oil in the furnace needs to be burned off, which generates a large amount of smoke. In this instance, a technician can activate the bypass, preventing the smoke detection device from causing burner 110 to be shut off prematurely, e.g., before the residual oil is burned off. The bypass can be an integral component of furnace system 200, e.g., such as a switch that is activated at the time of servicing.

While FIG. 2 depicts infrared beam transmitting unit 214 and infrared beam receiving unit 218 mounted directly on flue 104, this particular configuration is not required. Infrared beam transmitting unit 214 is configured to communicate with infrared beam receiving unit 218 via infrared beam 222 at distances of up to about ten feet. Thus, as long as infrared beam transmitting unit 214 and infrared beam receiving unit 218 are facing each other and are in line of sight of each other, and at least a portion of infrared beam 222 can pass through portals 224 and 226, then any one of a number of mounting configurations is possible. For example, if furnace system 200 is located in a room having walls on opposing sides of flue 104 that are less than ten feet apart, then infrared beam transmitting unit 214 and/or infrared beam receiving unit 218 can be mounted on the opposing walls.

Figure 3:
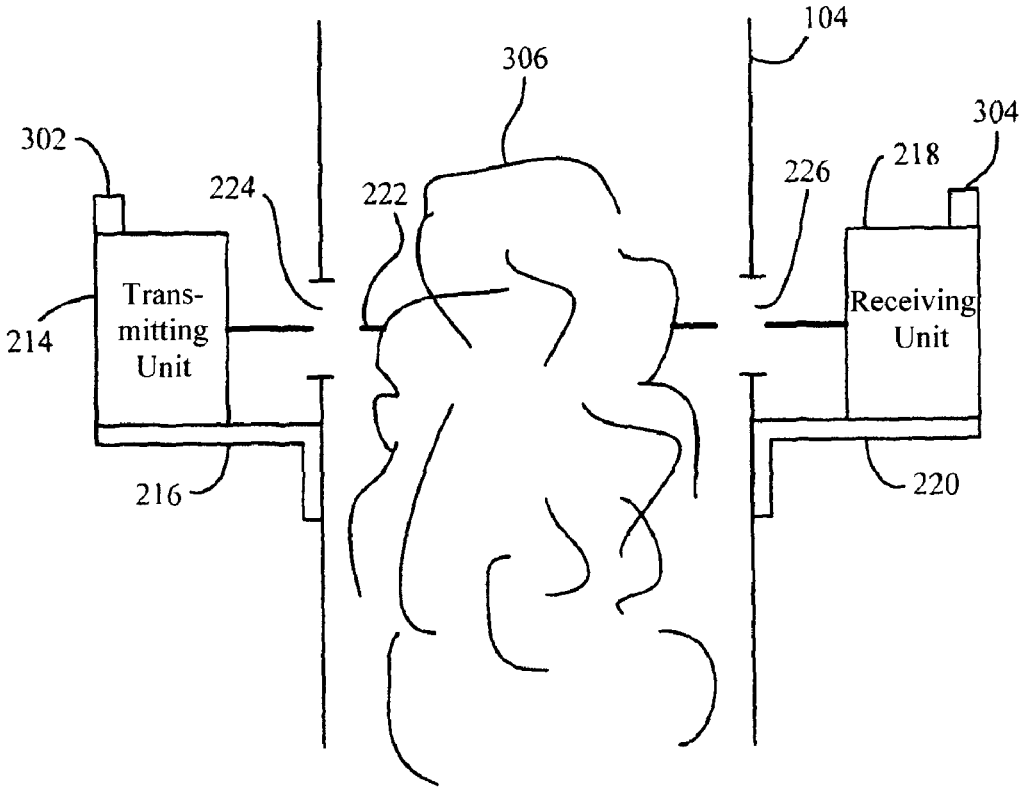
FIG. 3 is a diagram illustrating a detailed view of an infrared beam transmitting unit and an infrared beam receiving unit according to an embodiment of the present invention.

FIG. 3 is a diagram illustrating a detailed view of infrared beam transmitting unit 214 and infrared beam receiving unit 218. Infrared beam transmitting unit 214, infrared beam receiving unit 218 and associated components were disclosed in conjunction with the description of FIG. 2, above. It is shown in FIG. 3 that infrared beam transmitting unit 214 and infrared beam receiving unit 218 have light-emitting diodes (LEDs) 302 and 304, respectively, associated therewith. LEDs 302 and 304 aid in aligning infrared beam transmitting unit 214 and infrared beam receiving unit 218 with each other. Specifically, infrared beam 222 produced by infrared beam transmitting unit 214 has to make contact with a certain portion of infrared beam receiving unit 218 for the smoke detection device to function properly. LEDs 302 and 304 will become illuminated only when infrared beam 222 makes proper contact with infrared beam receiving unit 218. This feature is useful since infrared beam 222 is invisible to the human eye. Thus, someone installing infrared beam transmitting unit 214 and infrared beam receiving unit 218 can know that infrared beam transmitting unit 214 and infrared beam receiving unit 218 are aligned when LEDs 302 and 304 become illuminated.

As shown in FIG. 3, when smoke 306 in flue 104 is at, or above, a certain intensity level, infrared beam 222 is broken. As described above, this will result in a signal being sent from the smoke detection device to control module 230, to turn off burner 110.

During normal operation of a furnace system a certain level of smoke may be acceptable. Further, different furnaces, e.g., different model furnaces or furnaces of different ages, may have different acceptable levels of smoke production. Therefore, according to an exemplary embodiment, the sensitivity of infrared beam transmitting unit 214 and infrared beam receiving unit 218 can be adjusted for different smoke levels. This feature prevents a false signal from being sent by the infrared beam transmitting unit/infrared beam receiving unit to turn off burner 110 as a result of normal operation. In one exemplary embodiment, the sensitivity of the smoke detection device is adjusted at infrared beam transmitting unit 214. Specifically, infrared beam transmitting unit 214 is adjusted to either increase or decrease the intensity of infrared beam 222 produced thereby. By increasing the intensity of infrared beam 222, the sensitivity of the smoke detection device is decreased. Similarly, by decreasing the intensity of infrared beam 222, the sensitivity of the smoke detection device is increased.

In FIG. 3, it is shown that smoke 306 is present at, or above, a level that causes a break in infrared beam 222. As a result, the presence of smoke 306 effectuates a shut off of burner 110. Smoke levels can be determined using a smoke test kit, such as the True Spot® Smoke Test Kit manufactured by Bacharach, Inc. of Pittsburgh, Pa. Determining a smoke level using a smoke test kit is known to those of skill in the art and is not described further herein.

As mentioned above, different furnace models or furnaces of different ages might generate different acceptable levels of smoke during normal operation. For example, with older furnaces, up to a 3 (three) smoke level can be considered acceptable (with levels of 4 (four) smoke and greater being considered high). With many newer furnaces, however, any amount above a 2 (two) smoke level can be considered high.

Figure 4:
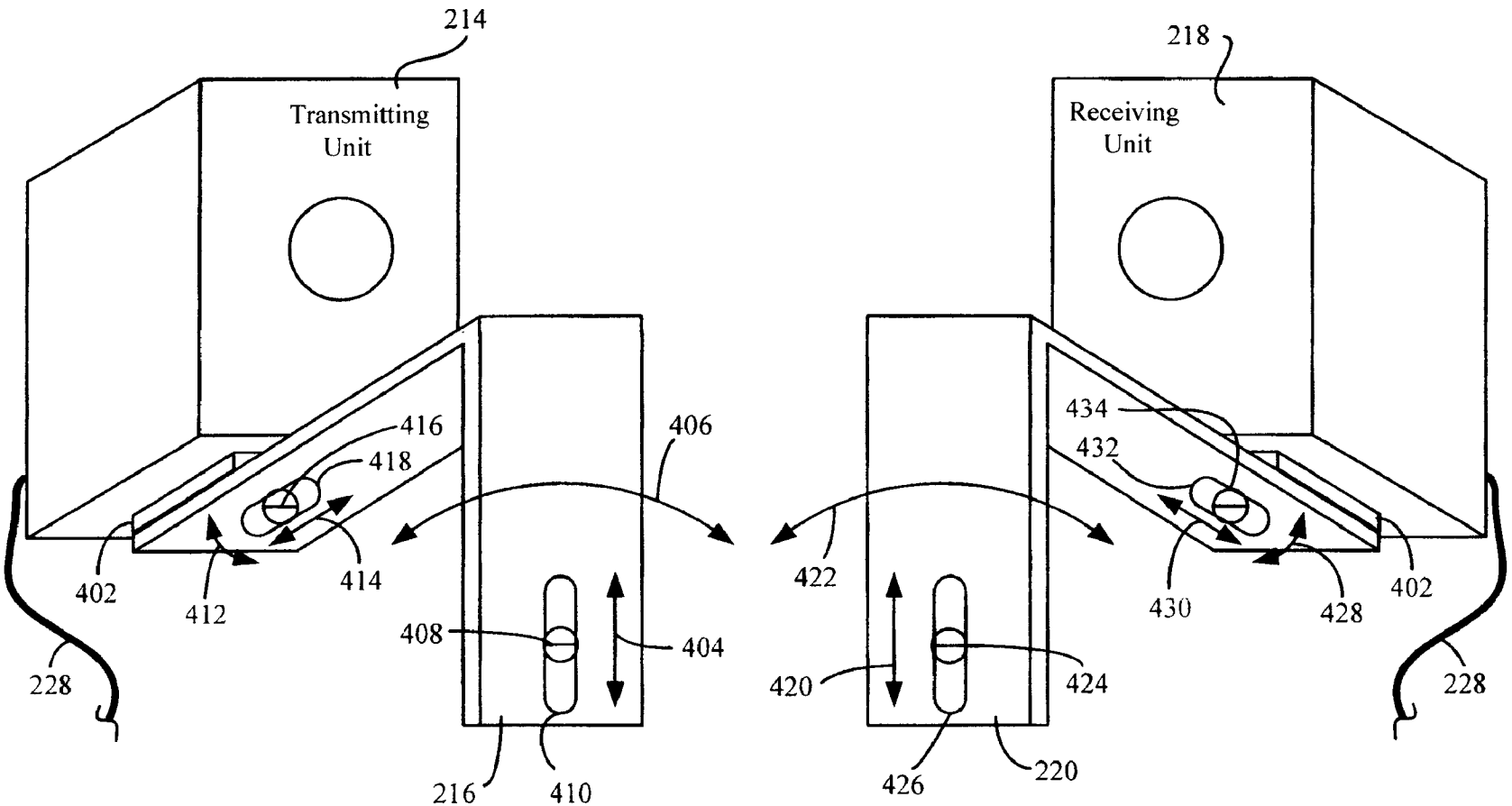
FIG. 4 is a diagram illustrating exemplary brackets for mounting a smoke detection device according to an embodiment of the present invention.

FIG. 4 is a diagram illustrating exemplary mounting brackets 216 and 220 for mounting a smoke detection device. Mounting brackets 216 and 220 were described, for example, in conjunction with the description of FIG. 2, above. Brackets 216 and 220 are "L-shaped" brackets, suitable for mounting infrared beam transmitting unit 214 and infrared beam receiving unit 218, respectively, perpendicular to opposing surfaces of flue 104. According to an exemplary embodiment, brackets 216 and 220 are made of a metallic material, including, but not limited to, one or more of steel, copper and aluminum.

As described above, infrared beam transmitting unit 214 has to be mounted in line of sight of infrared beam receiving unit 218, and vice versa. To aid in making adjustments to achieve proper alignment, brackets 216 and 220 each have adjustment points. Namely, with regard to bracket 216, height adjustment 404 and torsional adjustment 406 are achieved using screw 408 in channel 410. Specifically, screw 408 serves to attach bracket 216 to a surface of flue 104. According to an exemplary embodiment, screw 408 is a sheet metal screw that mates with a hole in flue 104. When screw 408 is threaded into the mating hole in flue 104, but prior to screw 408 being tightened down to flue 104, bracket 216 can be moved up and down, i.e., as screw 408 moves up and down within channel 410, and swung side to side, i.e., as screw 408 pivots within channel 410. When a correct orientation of bracket 216 is achieved, screw 408 can be tightened down fully to flue 104 to maintain that orientation.

Torsional adjustment 412 and distance adjustment 414 can also be made, and are achieved using screw 416 in channel 418. With regard to torsional adjustment 412, as described above, when screw 416 is threaded into a mating hole in the bottom surface of infrared beam transmitting unit 214, but prior to screw 416 being fully tightened down, infrared beam transmitting unit 214 can be pivoted on screw 416. Distance adjustment 414 is achieved by screw 416 moving back and forth within channel 418. A distance adjustment may be required to move infrared beam transmitting unit 214 either closer to, or farther away from, flue 104 and/or infrared beam receiving unit 218. For instance, some of the smoke produced during normal operation of furnace system 200 that escapes through portal 224 might negatively affect infrared beam transmitting unit 214, if infrared beam transmitting unit 214 is located too close to flue 104. In that instance, the distance between infrared beam transmitting unit 214 and flue 104 can be adjusted using screw 416/channel 418.

Similar adjustment points can also be present on bracket 220, as shown in FIG. 4. Namely, height adjustment 420 and torsional adjustment 422 are achieved using screw 424 and channel 426, as described above. Similarly, torsional adjustment 428 and distance adjustment 430 are achieved using screw 434 and channel 432, as described above. It is, however, not a requirement of the present teachings that both brackets 216 and 220 have adjustment points. For instance, according to an exemplary embodiment, only one of brackets 216 and 220 is adjustable.

An optional heat insulating layer, heat insulating layer 402, can be present between the top of bracket 216 and the bottom of infrared beam transmitting unit 214 and/or between the top of bracket 220 and the bottom of infrared beam receiving unit 218. Heat insulating layer 402 protects infrared beam transmitting unit 214/infrared beam receiving unit 218 from heat generated by flue 104 and transmitted through bracket 216/bracket 220, respectively. Heat insulating layer 402 can be composed of any suitable heat insulating material, including, but not limited to, rubber, plastic, ceramic and wood.

It is important to note that while the fasteners employed are described as screws, e.g., screws 408, 416, 424 and 434, any other suitable conventional fasteners may be similarly employed. Suitable other fasteners include, but are not limited to, bolts, rivets and threaded studs. Further, the bracket configurations shown in FIG. 4 are merely exemplary, and other bracket configurations for different applications are anticipated herein.

Figure 5:
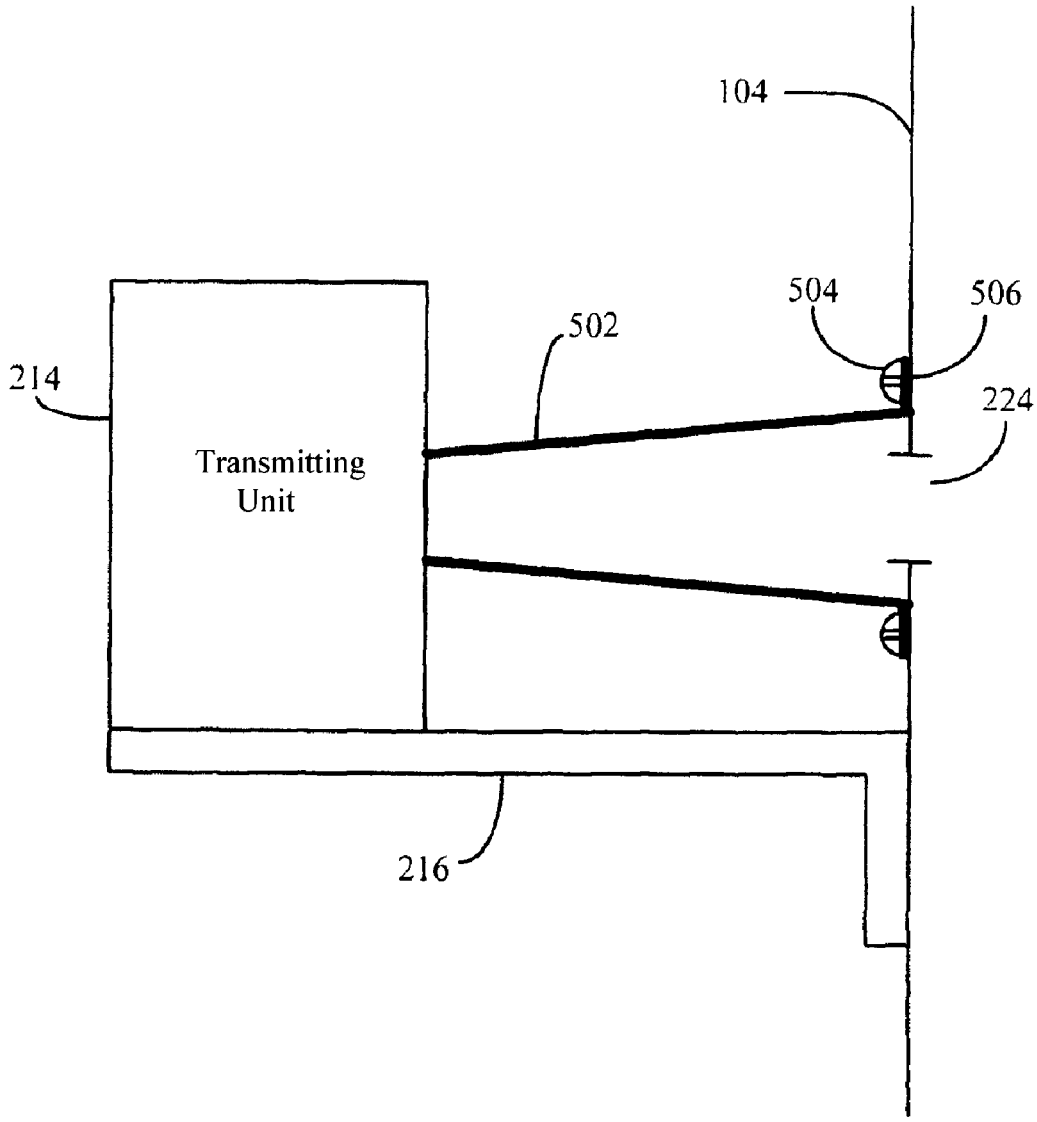
FIG. 5 is a diagram illustrating an exemplary smoke detection device-to-flue seal according to an embodiment of the present invention.

FIG. 5 is a diagram illustrating exemplary smoke detection device-to-flue seal 502. For ease of depiction, seal 502 is shown in conjunction with infrared beam transmitting unit 214, with the understanding that seal 502 may be similarly employed in conjunction with infrared beam receiving unit 218. Namely, seal 502 can comprise a tube or cone-shaped housing that extends from infrared beam transmitting unit 214 and/or infrared beam receiving unit 218 to flue 104, as shown in FIG. 5. It is to be understood that the depiction in FIG. 5 is a cross-sectional view, and that seal 502 comprises a continuous cylindrical or conical structure.

Seal 502 can be made of any material that is resistant to heat produced by flue 104, including, but not limited to, metallic materials, such as steel and aluminum. Seal 502 preferably comprises a mounting flange, i.e., mounting flange 506, that can mate with a surface of flue 104 and be attached to flue 104 using one or more screws, e.g., screws 504. A technician installing seal 502 can first line up seal 502 with the relevant component, e.g., either infrared beam transmitting unit 214 or infrared beam receiving unit 218, and then, based on that positioning, attach seal 502 to flue 104.

Seal 502 prevents smoke from exiting flue 104, e.g., through portal 224 and/or portal 226. Seal 502 is an optional component.

FIG. 6 is a diagram illustrating exemplary smoke detection device 601. Smoke detection device 601 is another possible configuration of smoke detection device 101 described, for example, in conjunction with the description of FIG. 1, above. As described above, smoke detection device 601, being associated with a furnace system, may also be referred to herein as a furnace smoke detection device.

Smoke detection device 601 comprises light guides 614 and 616, connected to infrared light module 618, and control module 630. Infrared light module 618 comprises infrared beam transmitting unit 618*a* and infrared beam receiving unit 618*b*. Infrared light module 618 transmits electrical signals to control module 630, i.e., via electrical conduit 628. As will be described in detail below, at least one function of control module 630 is to act as a switch connecting or disconnecting burner 110 from an electrical power source. Electrical conduit 628 is a powered connection, and as such, also provides power to infrared light module 618 from electrical power source 634. By way of example only, infrared light module 618 can be adapted to receive power via electrical conduit 628, as either 12 volts of direct current or 24 volts of alternating current, depending on the output of power source 634.

In an alternate embodiment, the infrared light module and the control module comprise a single integrated unit (not shown). The integrated unit would thus include an infrared beam transmitting unit and an infrared beam receiving unit.

As shown in FIG. 6, each of light guides 614 and 616 has a proximal end and a distal end. The proximal end of light guide 614 is attached and optically connected to infrared beam transmitting unit 618*a*. The distal end of light guide 614 is attached to flue 104. The attachment of light guides 614 and 616 to flue 104 will be described in detail below. The proximal end of light guide 616 is attached and optically connected to infrared beam receiving unit 618*b*. The distal end of light guide 616 is attached to flue 104. The distal ends of light guides 614 and 616 are attached to opposing sides of flue 104, and as such are in a non-contact position with each other. Further, the distal ends of light guides 614 and 616 are facing each other and are in line of sight of each other. The terms "proximal" and "distal," as used herein, are merely intended to distinguish one end of the light guide from another, and any other suitable terms may be similarly employed, such as, by way of example only "infrared beam transmitting/receiving unit-end" and "flue-end."

According to the exemplary embodiment shown in FIG. 6, light guides 614 and 616 comprise flexible optical fibers. The use of flexible optical fibers allows for a variety of different mounting configurations, including those that vary the positioning of infrared light module 618, e.g., relative to flue 104. Further, bends of up to 90 degrees (90°) can be introduced into light guide 614 and/or light guide 616 to accommodate different mounting configurations. For example, as shown in FIG. 6, a 90° bend is present at the distal end of light guide 614 to accommodate the routing of light guide 614 to infrared light module 618.

A furnace system, e.g., furnace system 600, is a high temperature environment. For example, operating temperatures typically range from about 400 degrees Fahrenheit (° F.) to about 500° F., but can be as high as 800° F. Thus, according to an exemplary embodiment, light guides 614 and 616 comprise high-temperature resistant optical fibers. Namely, the core, cladding and casing materials of the optical fibers are resistant to temperatures of up to about 900° F., e.g., up to about 600° F. In an exemplary embodiment, the casing material comprises a metal, including, but not limited to, stainless steel.

Light guides 614 and 616 are associated with a portion of flue 104 that is between furnace 102 and barometric damper 112, as shown in FIG. 6. As described above, this placement ensures that sensing is being conducted of furnace gasses that have not yet been diluted by incoming air from chimney 108. As such, more accurate smoke readings will be obtained.

Infrared beam transmitting unit 618*a* of infrared light module 618 produces infrared beam 620. Infrared beam 620 is conducted by light guide 614 to flue 104. Infrared beam 620 exits the distal end of light guide 614 and passes through flue 104. Infrared beam 620 then enters the distal end of light guide 616. As described below, the distance between the distal end of light guide 614 and the distal end of light guide 616, e.g., distance 615, can be up to about three feet. Thus, light guide 614 can conduct infrared beam 620 across a gap of up to about three feet to light guide 616. Light guide 616 then conducts infrared beam 620 to infrared beam receiving unit 618*b* of infrared light module 618.

Infrared light module 618 is configured to detect discontinuities in infrared beam 620. For example, if infrared beam 620 is broken by a high level of smoke passing through flue 104, then infrared light module 618 will detect this discontinuity. According to an exemplary embodiment, when a break in infrared beam 620 is detected, infrared light module 618 sends a signal, e.g., an electrical signal, to control module 630. The electrical signal will direct control module 630 to disconnect burner 110 from electrical power source 634. For example, control module 630 can comprise a relay switch that, without power source output, provides a closed electrical circuit from power source 634 to the electrical ignition mechanism of burner 110. However, when power source output, in the form of the electrical signal provided by infrared light module 618, is provided to control module 630 the relay opens, e.g., opening the electrical circuit between power source 634 and the electrical ignition mechanism.

Further, control module 630 can be configured such that when the electrical signal is received from infrared light module 618, control module 630 activates an alarm system. For example, control module 630 can be connected, e.g., via electrical conduit 639, to existing home/building alarm system 648. As described above, many conventional home/building alarm systems are set up to automatically send an alert to authorities, e.g., police and fire department, as well as, to the home/building owner, when the alarm is activated. When smoke detection device 601 is integrated into the alarm system, an alert can also be sent to the furnace service company.

While FIG. 6 shows control module 630 controlling one component of furnace system 600, i.e., burner 110, control module 630 may be used to control a plurality of components. By way of example only, in FIG. 14 (described below) control module 630 is employed to control multiple components in a ventilation system.

Since infrared light module 618 receives its operating power through electrical conduit 628, a dedicated powered connection, infrared light module 618 is powered continuously, regardless of whether control module 630 has effectuated the shutting off of burner 110. This will provide protection, for example, at the time of burner shut-off and will serve to detect smoke in the case of a faulty pump cut-off device. Control module 630 is powered through safety devices commonly found in standard equipment, such as load cell relays.

An optional bypass 642 of control module 630 can be incorporated in furnace system 600. Specifically, bypass 642 allows for burner 110 to remain on, even when smoke is detected by smoke detection device 601 and a signal is sent to control module 630 to turn off burner 110. Namely, bypass 642 acts as a temporary connection between burner 110 and power source 634, i.e., via electrical conduits 644 and 646. As described in conjunction with the description of FIG. 2, above, a bypass, e.g., bypass 642, that can be activated by a technician is useful during the servicing of a furnace system, when large amounts of smoke are knowingly generated. In an exemplary embodiment, bypass 642 includes a push-button switch 643 that can be activated at the time of servicing.

Figure 8:
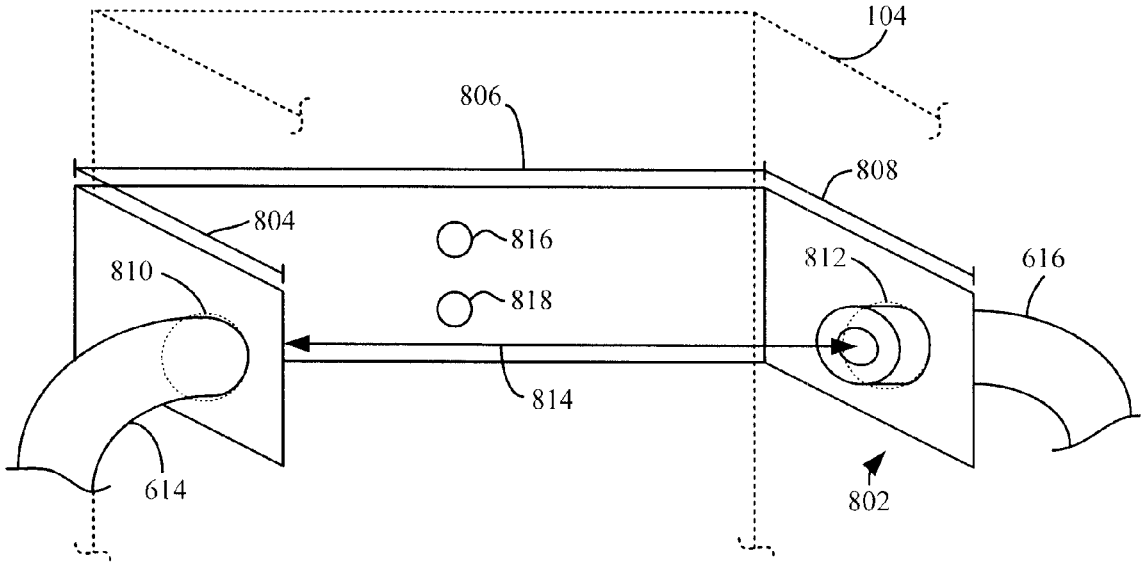
FIG. 8 is a diagram illustrating an exemplary light guide mounting bracket according to an embodiment of the present invention.

While FIG. 6 depicts the distal ends of light guides 614 and 616 as being directly mounted to flue 104, this particular configuration is not required. According to the present teachings, as described above, distance 615 between the distal ends of light guides 614 and 616 can equal up to about three feet. Therefore, as long as the distal ends of light guides 614 and 616 are in line of sight of each other, and infrared beam 620 can pass through at least a portion of flue 104, then any one of a number of mounting configurations is possible. For example, as is shown in FIG. 8, and described below, the distal ends of light guides 614 and 616 may be mounted to a bracket and the bracket mounted to flue 104.

Figure 7:
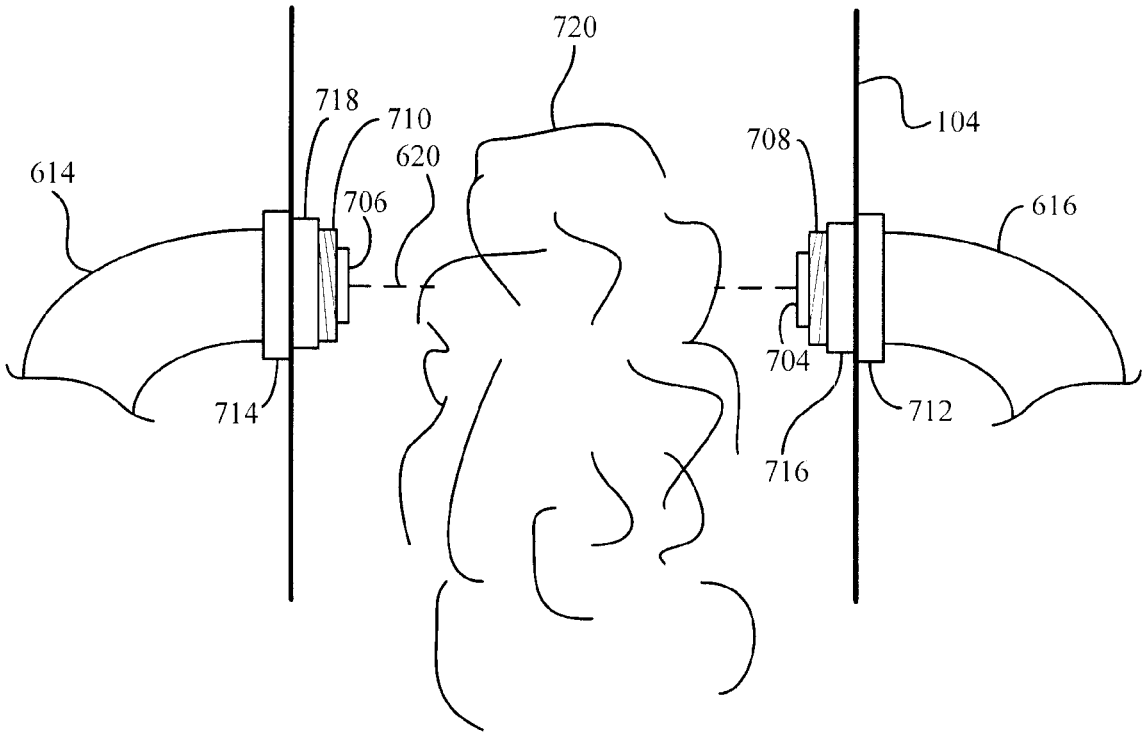
FIG. 7 is a diagram illustrating light guides mounted to a flue according to an embodiment of the present invention.

FIG. 7 is a diagram illustrating light guides 614 and 616 mounted to flue 104. According to the exemplary embodiment shown in FIG. 7, light guide 614 and light guide 616 are optical fibers comprising core/cladding 706 and core/cladding 704, respectively. The structure of an optical fiber, including the core and cladding materials and configurations thereof, is well known to those of skill in the art and is not described further herein.

To mount light guides 614 and 616 to flue 104, two holes are first made at opposing ends of flue 104. The holes are each of a diameter that approximates the diameter of threaded portions 710 and 708 on the distal ends of light guides 614 and 616, respectively. Employing holes of the proper diameter is important, as once the mounting techniques (described below) are implemented, a tight seal of light guides 614 and 616 to flue 104 results and smoke is prevented from escaping through the holes.

According to one exemplary embodiment, nuts, or similar-type fasteners, e.g., nuts 712 and 714 are then screwed onto each of threaded portions 708 and 710, respectively. A depth of nut 712 and nut 714 on each of threaded portions 708 and 710, respectively, can be used to set a length that the corresponding light guide extends into flue 104. Threaded portions 708 and 710 are then placed through the respective holes in flue 104, and a second set of nuts, or similar-type fasteners, e.g., nuts 716 and 718 are screwed onto each of threaded portions 708 and 710, respectively, to secure the light guides to flue 104.

With the above mounting techniques, it is important that the holes made in flue 104 accurately position the distal ends of light guides 614 and 616 in line of sight of each other, for proper functioning of smoke detection device 601. To aid in lining up the holes, a template may be employed. For example, a paper template showing the correct placement of the holes can be first placed, e.g., taped, to flue 104 and the holes drilled accordingly.

Alternatively, as will be described in detail, for example, in conjunction with the description of FIG. 8, below, a bracket for mounting light guides 614 and 616 to flue 104 may be employed. The bracket serves to set the positioning of the light guides relative to each other.

According to an exemplary embodiment, control module 630 (described in conjunction with the description of FIG. 6, above) further comprises an indicator, e.g., an indicator light, that is illuminated when light guides 614 and 616 are properly aligned such that infrared beam 620 emitted by light guide 614 is being properly received by light guide 616. Such an indicator would be useful to someone installing smoke detection device 601 on a furnace.

As shown in FIG. 7, when smoke 720 in flue 104 is at, or above, a certain intensity level, infrared beam 620 is broken. As described above, this will result in a signal being sent from infrared light module 618 to control module 630, to turn off burner 110.

During normal operation of a furnace system, a certain level of smoke may be acceptable. Further, different furnaces, e.g., different model furnaces or furnaces of different ages, may have different acceptable levels of smoke production. Therefore, according to an exemplary embodiment, the sensitivity of infrared light module 618 can be adjusted for different smoke levels. This feature prevents a false signal from being sent by infrared light module 618 to turn off burner 110 as a result of normal operation. In one exemplary embodiment, infrared light module 618 has a control that permits the user to adjust the sensitivity of smoke detection device 601. Specifically, the control either increases or decreases the intensity of infrared beam 620 produced by infrared beam transmitting unit 618*a*. By increasing the intensity of infrared beam 620, the sensitivity of the smoke detection device is decreased. Similarly, by decreasing the intensity of infrared beam 620, the sensitivity of the smoke detection device is increased.

Being able to adjust the intensity of infrared beam 620 is beneficial in several other instances. Namely, the intensity of infrared beam 620 can be adjusted to accommodate flue pipes of different dimensions. For example, if dimension 615 of flue 104, described in conjunction with the description of FIG. 6, above, was to increase, then the intensity of infrared beam 620 can also be increased to compensate for the added distance over which infrared beam 620 has to travel between light guides.

Further, according to an exemplary embodiment, adjustments to the intensity of infrared beam 620 can be made automatically to accommodate for soot build-up on the light guides, over time, that leads to decreased sensitivity. By way of example only, infrared light module 618 may be configured to automatically compare the intensity of infrared beam 620 being produced by infrared beam transmitting unit 618*a* with the intensity of infrared beam 620 being received by infrared beam receiving unit 618*b*. Absent a break in infrared beam 620 by an excessive smoke condition, it is expected that the intensity of infrared beam 620 being received by infrared beam receiving unit 618*b* will decrease over time, due to soot build-up. Infrared light module 618 can be configured to automatically make adjustments, e.g., increasing adjustments, to the intensity of infrared beam 620 to compensate for this loss in sensitivity. Care must be taken, however, when configuring infrared light module 618 to make such adjustments, so that the intensity of infrared beam 620 is not increased beyond a point at which a beam break would not occur as a result of an excessive smoke condition.

FIG. 8 is a diagram illustrating exemplary light guide mounting bracket 802. As shown in FIG. 8, bracket 802 is a "u-shaped" bracket with mounting holes 810 and 812 for light guides 614 and 616, respectively. Light guides 614 and 616 can be mounted to bracket 802 using the mounting techniques described, for example, in conjunction with the description of FIG. 7, above. Namely, via a threaded portion on the end of each light guide, a combination of two nuts, or similar fasteners, may be used to secure the light guides to bracket 802.

Alternatively, light guides 614 and 616 may be permanently affixed to bracket 802. By way of example only, during manufacture of smoke detection device 601, light guides 614 and 616 may be affixed to bracket 802 using an adhesive and/or a sealant (e.g., a high-temperature resistant sealant) or may be press-fit into bracket 802.

An important aspect of bracket 802 is that bracket 802 holds light guides 614 and 616 in a fixed orientation relative to each other, i.e., maintaining the distal ends of light guides 614 and 616 in line of sight 814 of each other. Thus, much of the on-site measurements required during installation of smoked detection device 601 on a furnace system are eliminated. Namely, during installation, bracket 802 (which can be a pre-manufactured component of smoke detection device 601) can be mounted to the flue, e.g., via mounting holes 816 and 818 in combination with any one of a number of suitable fasteners, including, but not limited to, screws, rivets and threaded studs/nuts.

According to one exemplary embodiment, as shown in FIG. 8, the dimensions of bracket 802, namely, dimensions 804, 806 and 808, approximate the outer dimensions of flue 104. As such, any one of dimensions 804, 806 and 808 can be varied to accommodate different flue pipe dimensions. For example, a variety of brackets 802 can be pre-manufactured with dimensions 804, 806 and 808 adapted to the dimensions of the most commonly used flue pipes.

The use of bracket 802 still requires that holes be made on opposing ends of flue 104 for light guides 614 and 616, However, bracket 802 ensures that the proper orientation of light guide 614 in relation to light guide 616 is maintained.

Figure 9:
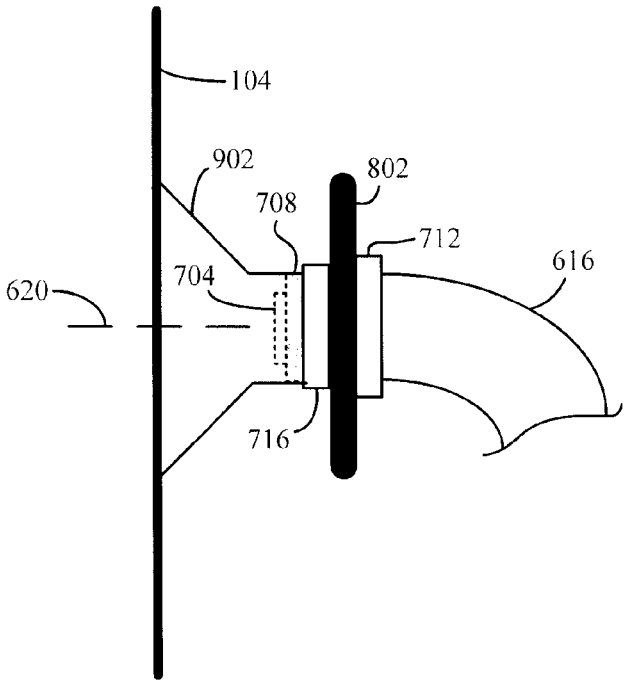
FIG. 9 is a diagram illustrating an exemplary light guide mounting configuration according to an embodiment of the present invention.

In an alternative embodiment, dimension 806 of bracket 802 is greater than the same outer dimension of flue 104, such that the ends of light guides 614 and 616 do not pass into flue 104. This configuration is shown in FIG. 9. FIG. 9 is a diagram illustrating an exemplary light guide mounting configuration, wherein bracket 802 positions the distal ends of the light guides at a distance from flue 104. For ease of description, FIG. 9 only depicts the mounting of light guide 616. However, it is to be understood that the mounting of light guide 614 would be identical.

As shown in FIG. 9, housing structure 902 extends from the distal end of light (guide 616 to flue 104. In an exemplary embodiment, housing structure 902 has a cone-shaped, or a similar-type shaped, structure wherein an end of housing structure 902 adjacent to light guide 616 has a smaller diameter than an end of housing structure 902 adjacent to flue 104. The end of housing structure 902 adjacent to light guide 616 may also be threaded and adapted to screw onto the end of threaded portion 708. It is to be understood that the depiction in FIG. 9 is a cross-sectional view, and that housing structure 902 comprises a continuous cylindrical or conical structure.

The use of housing structure 902 would allow a technician installing smoke detection device 601 on a furnace system a degree of leeway when drilling the holes in flue 104. Namely, the holes in flue 104 may be made having a diameter that is slightly larger than the diameter of light guide 616, so long as the diameters of the holes made in flue 104 do not exceed the diameter of the end of housing structure 902 adjacent to flue 104. That way, housing structure 902 can seal the light guides to the flue and prevent furnace gasses from escaping from the holes in the flue. The use of housing structure 902 is optional.

Figure 10:
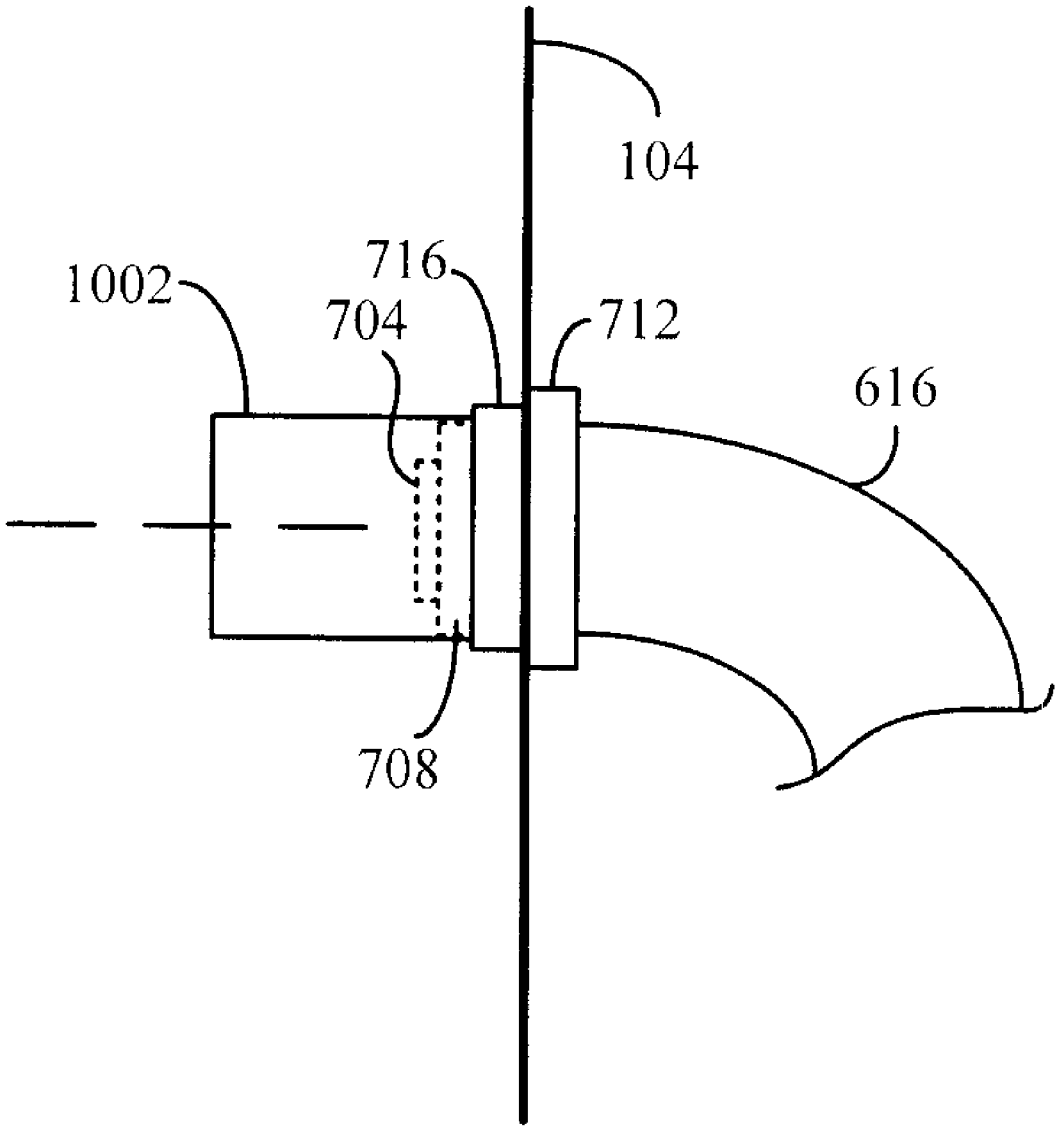
FIG. 10 is a diagram illustrating an exemplary light guide shield according to an embodiment of the present invention.

FIG. 10 is a diagram illustrating exemplary light guide shield 1002. As described, for example, in conjunction with the description of FIG. 7, above, light guides 614 and 616 may be mounted directly to flue 104. In that instance, a portion of the distal ends of each light guide passes into flue 104. If left unexposed, the ends of the light guides are subject to furnace gasses traveling up flue 104 which can cause soot to accumulate on the ends of the light guides, decreasing sensitivity and hurting performance of the smoke detection device.

Light guide shield 1002 can be implemented to minimize the amount of soot build-up on the ends of the light guides. For ease of description, FIG. 10 only depicts light guide shield 1002 being mounted on the distal end of light guide 616, however, it is to be understood that a light guide shield would also be mounted on light guide 614 in the same manner as described.

It is to be understood that the depiction in FIG. 10 is a cross-sectional view, and that light guide shield 1002 comprises a continuous, e.g., cylindrical, structure. Namely, according to an exemplary embodiment, light guide shield 1002 is a tube structure, one end of which is threaded and adapted to screw onto the threaded portions on the distal ends of each of the light guides, e.g., threaded portions 710 and 708 of light guides 614 and 616, respectively. When implemented, light guide shield 1002 minimizes soot build up on the core/cladding of the light guides.

Figure 11:
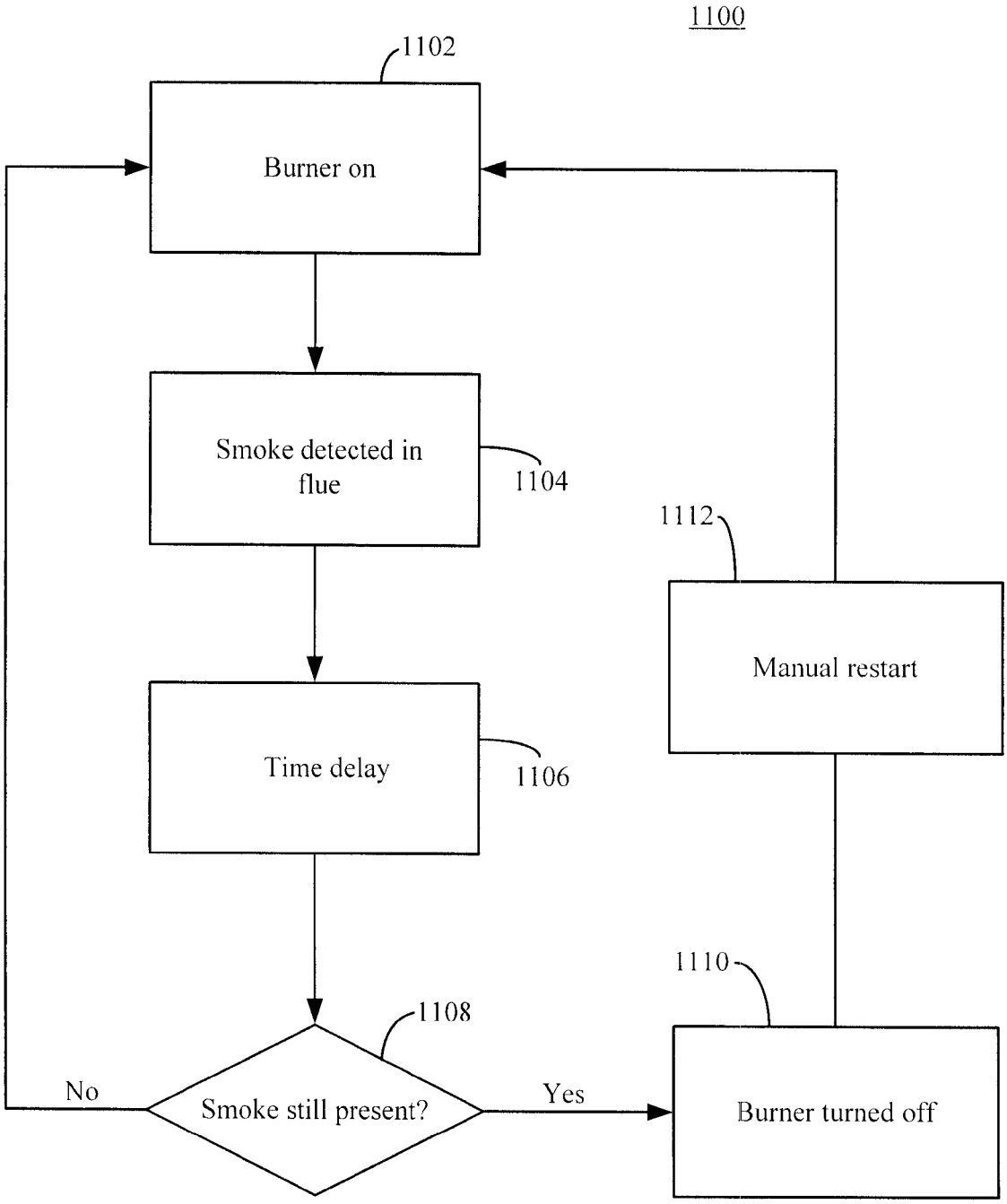
FIG. 11 is a diagram illustrating an exemplary methodology for smoke detection in a furnace system according to an embodiment of the present invention.

FIG. 11 is a diagram illustrating exemplary methodology 1100 for smoke detection in a furnace system. In step 1102, burner 110 is on and the furnace system is running. In step 1104, smoke is detected in flue 104 by one or more of the smoke detection devices described herein. e.g., smoke detection device 201 or smoke detection device 601. Namely, smoke is present in flue 104 at, or above, a level that results in a break in the infrared beam, i.e., a break in infrared beam 222 between infrared beam transmitting unit 214 and infrared beam receiving unit 218 (in the case of smoke detection device 201) or a break in infrared beam 620 between light guides 614 and 616 (in the case of smoke detection device 601).

As a result of the infrared beam being broken by the smoke present in flue 104, a signal is sent to the control module. For example, in the case of smoke detection device 201, a signal can be sent from infrared beam receiving unit 218 to control module 230. In the case of smoke detection device 601, a signal can be sent from infrared light module 618 to control module 630.

In step 1106, a time delay is instituted before any action is taken in response to the signal being sent to the control module. According to an exemplary embodiment, the time delay is for a duration of up to about 120 seconds. Time delays for durations of up to about 90 seconds, up to about 60 seconds, or up to about 30 seconds, can also be similarly employed.

After the prescribed time delay period has ended, in step 1108 a determination is then made, e.g., at the control module, as to whether there is still smoke present in flue 104. Namely, alter the time delay period has ended, a determination is made as to whether there is still a signal being sent to the control module.

By way of example only, the control module can comprise a time delay circuit that will effectuate disconnecting the burner from its power source only if, after the time delay period has ended, there is still a signal present, as in step 1110. According to a preferred embodiment, the control module has to be manually activated, i.e., "flipped," to restart burner 110. Thus, in step 1112, burner 110 is manually restarted. Prior to manually restarting burner 110, the furnace system can be serviced and the smoke condition examined. According to an exemplary embodiment, the control module has a restart button that pops out when a signal is received and burner 110 is turned off. The button has to be manually pushed in to restart burner 110. Employing a manual restart button is beneficial, as it serves to prevent short cycling of the furnace system, which can lead to soot build-up. If, on the other hand, no signal is detected, then burner 110 is permitted to remain on and the time delay period associated with the control module is reset.

The implementation of a time delay period will prevent premature burner shut-offs and allow for small problems to dissipate. While it is a beneficial feature, the time delay period is not a requirement in all cases, and embodiments are anticipated herein where the signal causes the control module to instantly turn off burner 110.

Figure 12:
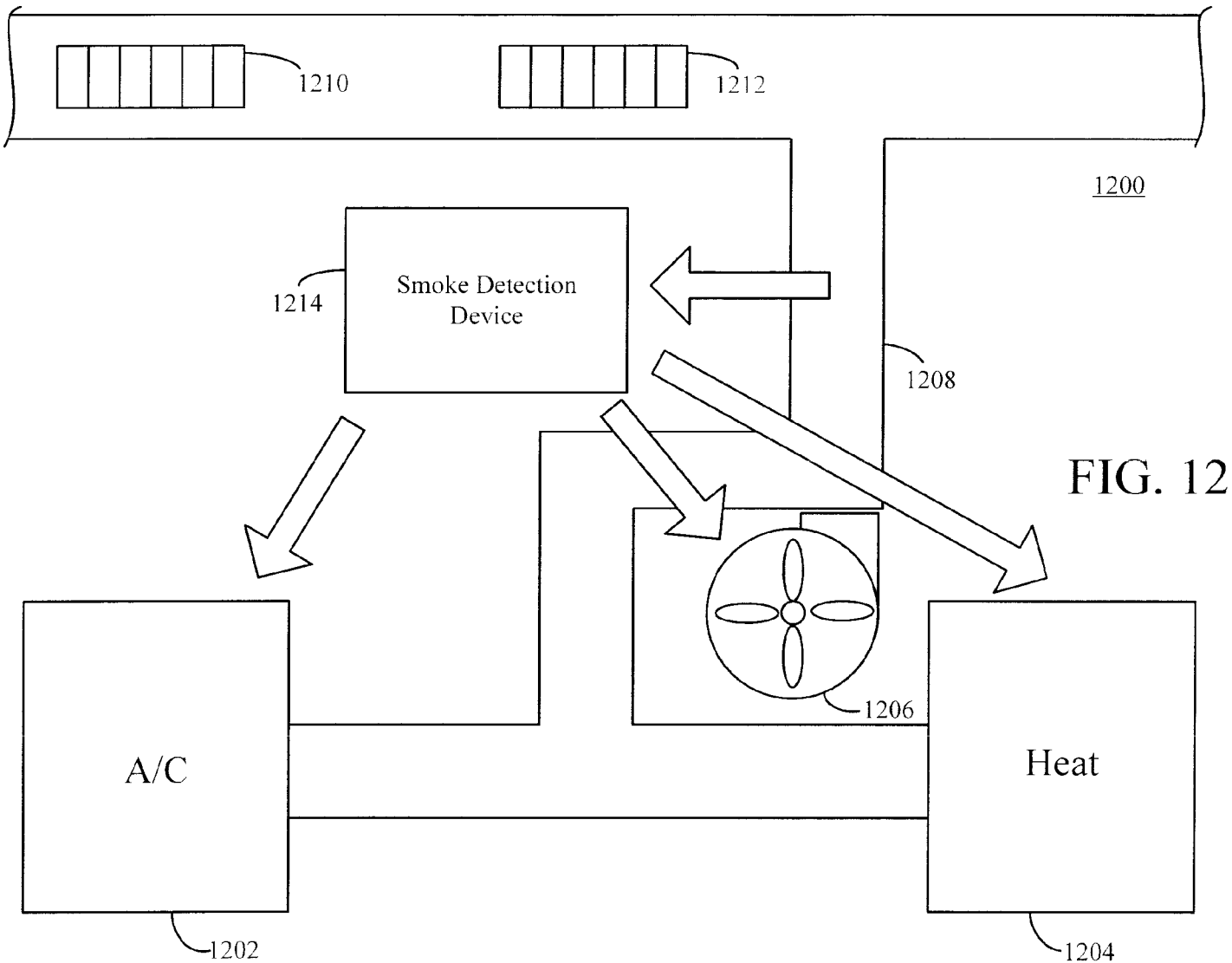
FIG. 12 is a diagram illustrating an exemplary ventilation system having a smoke detection device associated therewith according to an embodiment of the present invention.

FIG. 12 is a diagram illustrating exemplary ventilation system 1200 having smoke detection device 1214 associated therewith. Ventilation system 1200 includes air conditioning unit (A/C unit) 1202, heating unit 1204, air distribution fan 1206 and duct 1208. The inclusion of both an A/C unit and a heating unit within ventilation system 1200 is merely exemplary, and embodiments are anticipated herein, for example, wherein only a heating unit is present. Heating unit 1204 can be an oil-fired furnace system, such as furnace system 100 (described, for example, in conjunction with the description of FIG. 1, above), or any other conventional heating unit, including, but not limited to, a gas or an electric heating unit.

Air distribution fan 1206 serves to distribute the warmed air from heating unit 1204 and the cooled air from A/C unit 1202 through duct 1208 and out to the interior of a building or dwelling via vents 1210 and 1212. The functioning of an air distribution fan is known to those of skill in the art, and is not described further herein.

According to the present teachings, a smoke detection device, i.e., smoke detection device 1214 is associated with duct 1208 in ventilation system 1200. Namely, as shown in FIG. 1 and as will be described in detail below, smoke detection device 1214 can be employed to sense smoke present in duct 1208 and is configured to switch one or more of A/C unit 1202, heating unit 1204 and air distribution fan 1206 off in response to a high smoke condition, e.g., greater than a preset threshold level of smoke present, within duct 1208. Since smoke detection device 1214 is associated with duct 1208, smoke detection device 1214 may also be referred to herein as an in-line duct smoke detection device.

Figure 13:
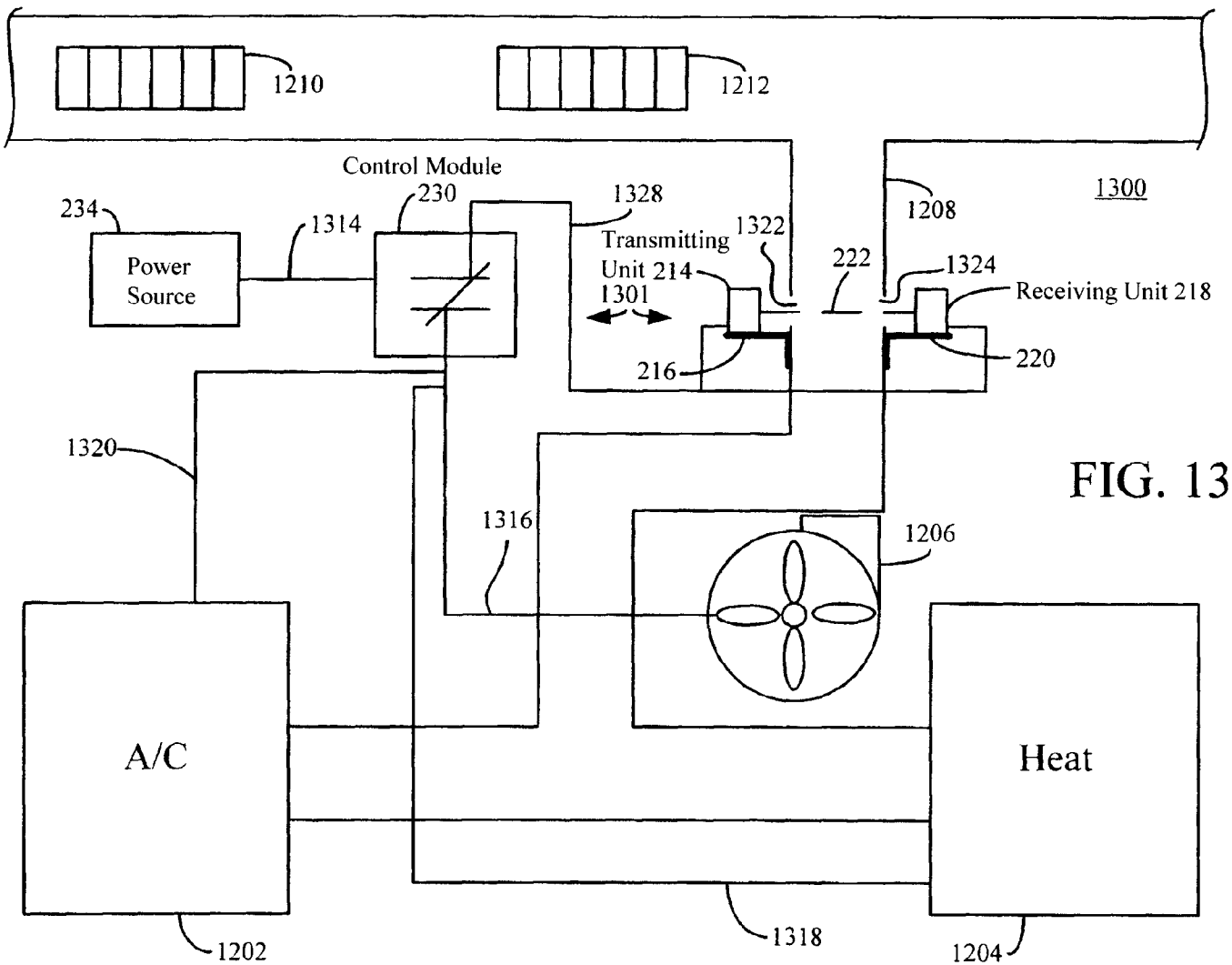
FIG. 13 is a diagram illustrating one possible configuration of the smoke detection device of FIG. 12 according to an embodiment of the present invention.

FIG. 13 is a diagram illustrating exemplary smoke detection device 1301. Smoke detection device 1301 is one possible configuration of smoke detection device 1214 described in conjunction with the description of FIG. 12, above. As described above, smoke detection device 1301, being associated with duct 1208, may also be referred to herein as an in-line duct smoke detection device.

Smoke detection device 1301 functions in essentially the same manner as smoke detection device 201, described, for example, in conjunction with the description of FIG. 2, above. Namely, smoke detection device 1301 comprises infrared beam transmitting unit 214 and infrared beam receiving unit 218 (that communicate with each other via infrared beam 222), and control module 230. As will be described in detail below, at least one function of control module 230 is to act as a switch connecting or disconnecting one or more of A/C unit 1202, heating unit 1204 and air distribution fan 1206 from electrical power source 234.

Infrared beam transmitting unit 214 and infrared beam receiving unit 218 are mounted to duct 1208 using brackets 216 and 220, respectively. Infrared beam 222 passes through duct 1208 via portals 1322 and 1324.

A/C unit 1202, heating unit 1204 and air distribution fan 1206 are all connected to electrical power source 234 through control module 230. Specifically, A/C unit 1202 is connected to control module 230 via electrical conduit 1320, heating unit 1204 is connected to control module 230 via electrical conduit 1318 and air distribution fan 1206 is connected to control module 230 via electrical conduit 1316. Control module 230 is in turn connected to power source 234 via electrical conduit 1314.

When smoke is detected in duct 1208, e.g., smoke is present in duct 1208 at, or above, a level that causes a break in infrared beam 222, a signal is sent from smoke detection device 1301 to control module 230 via electrical conduit 1328. According to an exemplary embodiment, the signal is an electrical signal such that when infrared beam 222 is broken, smoke detection device 1301 gives power source output (the signal) to control module 230 to activate control module 230. Control module 230, when activated, will then turn off A/C unit 1202, heating unit 1204 and air distribution fan 1206, For example, control module 230 can be a relay switch that, without power source output, provides a closed electrical circuit from power source 234 to each of A/C unit 1202, heating unit 1204 and air distribution fan 1206. However, when power source output is provided to control module 230, control module 230 opens, e.g., opening the electrical circuit between power source 234 and each of A/C unit 1202, heating unit 1204 and air distribution fan 1206.

The features described in conjunction with smoke detection device 201, above, including the mounting bracket configurations, are also applicable to smoke detection device 1301. An in-line duct smoke detection device is beneficial as it shuts off the ventilation components in the event of, e.g. a fire, in a building or dwelling. Specifically, the ventilation components, through the air distribution fan, can exacerbate fire/smoke conditions if left running during a fire. Once smoke is detected in the duct, smoke detection device 1301 will turn off the ventilation components. Further, commercial building safety codes require an in-line duct smoke detection system. Smoke detection device 1301 could meet these requirements.

Figure 14:
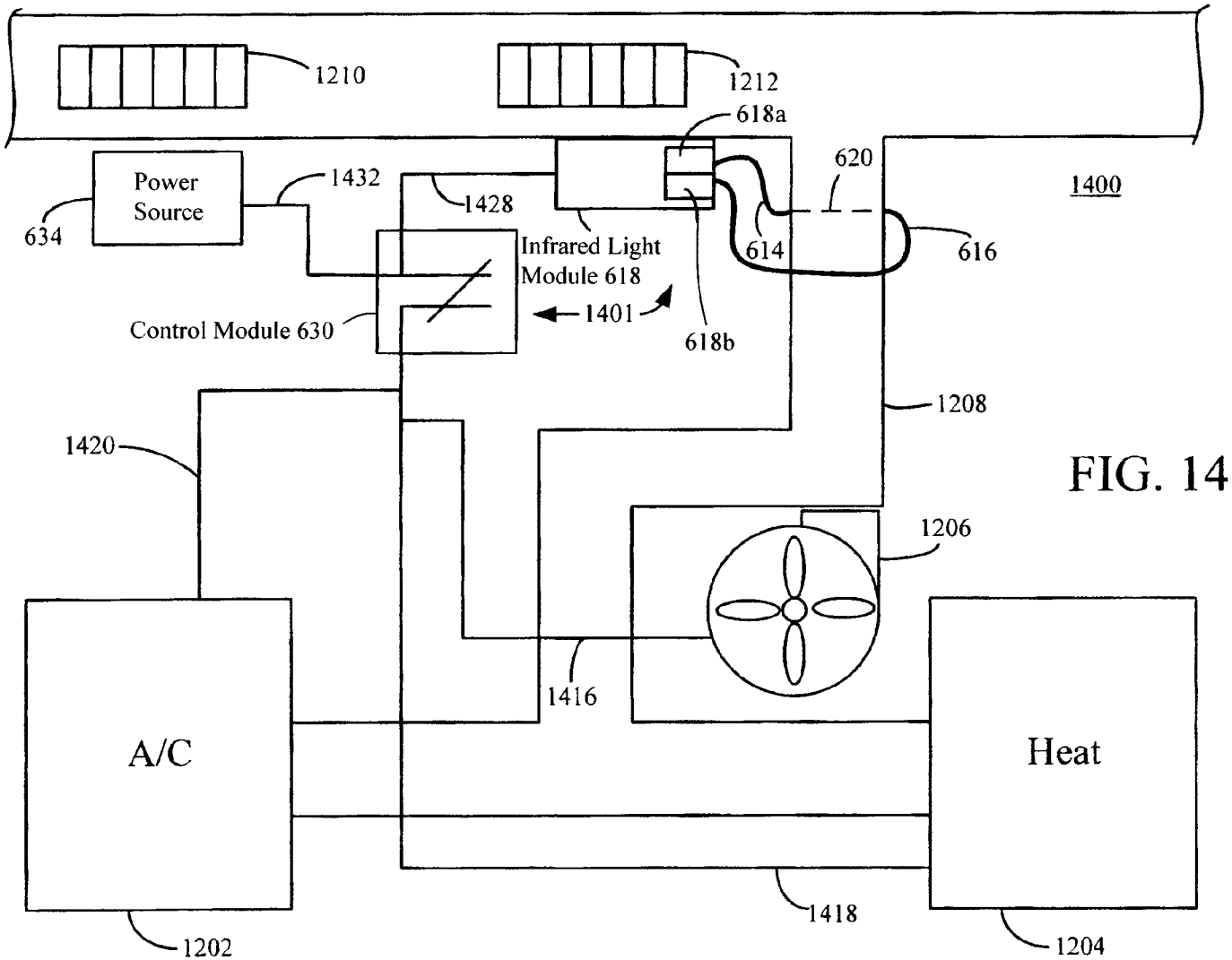
FIG. 14 is a diagram illustrating another possible configuration of the smoke detection device of FIG. 12 according to an embodiment of the present invention.

FIG. 14 is a diagram illustrating exemplary smoke detection device 1401. Smoke detection device 1401 is another possible configuration of smoke detection device 1214 described, for example, in conjunction with the description of FIG. 12, above. As shown in FIG. 14, smoke detection device 1401 is associated with duct 1208. As described above, a smoke detection device associated with the duct in a ventilation system may also be referred to herein as an in-line duct smoke detection device.

Smoke detection device 1401 functions in essentially the same manner as smoke detection device 601, described, for example, in conjunction with the description of FIG. 6, above. Namely, smoke detection device 1401 comprises light guides 614 and 616 connected to infrared light module 618, and control module 630. Infrared light module 618 comprises infrared beam transmitting unit **618*a* and infrared beam receiving unit 618*b*. Infrared light module 618 transmits electrical signals to control module 630 via electrical conduit 1428**.

A/C unit 1202, heating unit 1204 and air distribution fan 1206 are all connected to electrical power source 634 through control module 630. Specifically, A/C unit 1202 is connected to control module 630 via electrical conduit 1420, heating unit 1204 is connected to control module 630 via electrical conduit 1418 and air distribution fan 1206 is connected to control module 630 via electrical conduit 1416. Control module 630 is in turn connected to power source 634 via electrical conduit 1432.

Infrared beam transmitting unit **618*a* of infrared light module 618 produces infrared beam 620. Infrared beam 620 is conducted by light guide 614 to duct 1208. Infrared beam 620 exits the distal end of light guide 614 and passes through duct 1208. Infrared beam 620 then enters the distal end of light guide 616. As described, for example, in conjunction with the description of FIG. 6, above, the distance between the distal end of light guide 614 and the distal end of light guide 616 can be up to about three feet. Thus, light guide 614 can conduct infrared beam 620 across a gap of, e.g., across duct 1208 having a distance of, up to about three feet to light guide 616. Light guide 616 then conducts infrared beam 620 to infrared beam receiving unit 618*b* of infrared light module 618**.

When smoke is detected in duct 1208, e.g., smoke is present in duct 1208 at, or above, a level that causes a break in infrared beam 620, a signal is sent from infrared light module 618 to control module 630 via electrical conduit 1428. According to an exemplary embodiment, the signal is an electrical signal such that when infrared beam 620 is broken, infrared light module 618 gives power source output (the signal) to control module 630 to activate control module 630. Control module 630, when activated, will then turn off A/C unit 1202, heating unit 1204 and air distribution fan 1206. For example, control module 630 can comprise a relay switch that, without power source output, provides a closed electrical circuit from power source 634 to each of A/C unit 1202, heating unit 1204 and air distribution fan 1206. However, when power source output is provided to control module 630, the relay switch opens, e.g., opening the electrical circuit between power source 634 and each of A/C unit 1202, heating unit 1204 and air distribution fan 1206.

The features described above in conjunction with smoke detection device 601, including the different mounting configurations, are also applicable to smoke detection device 1401. As described above, an in-line duct smoke detection device, such as smoke detection device 1401, is beneficial, e.g., in the event of a fire, and can be used to meet commercial building safety codes.

Figure 15:
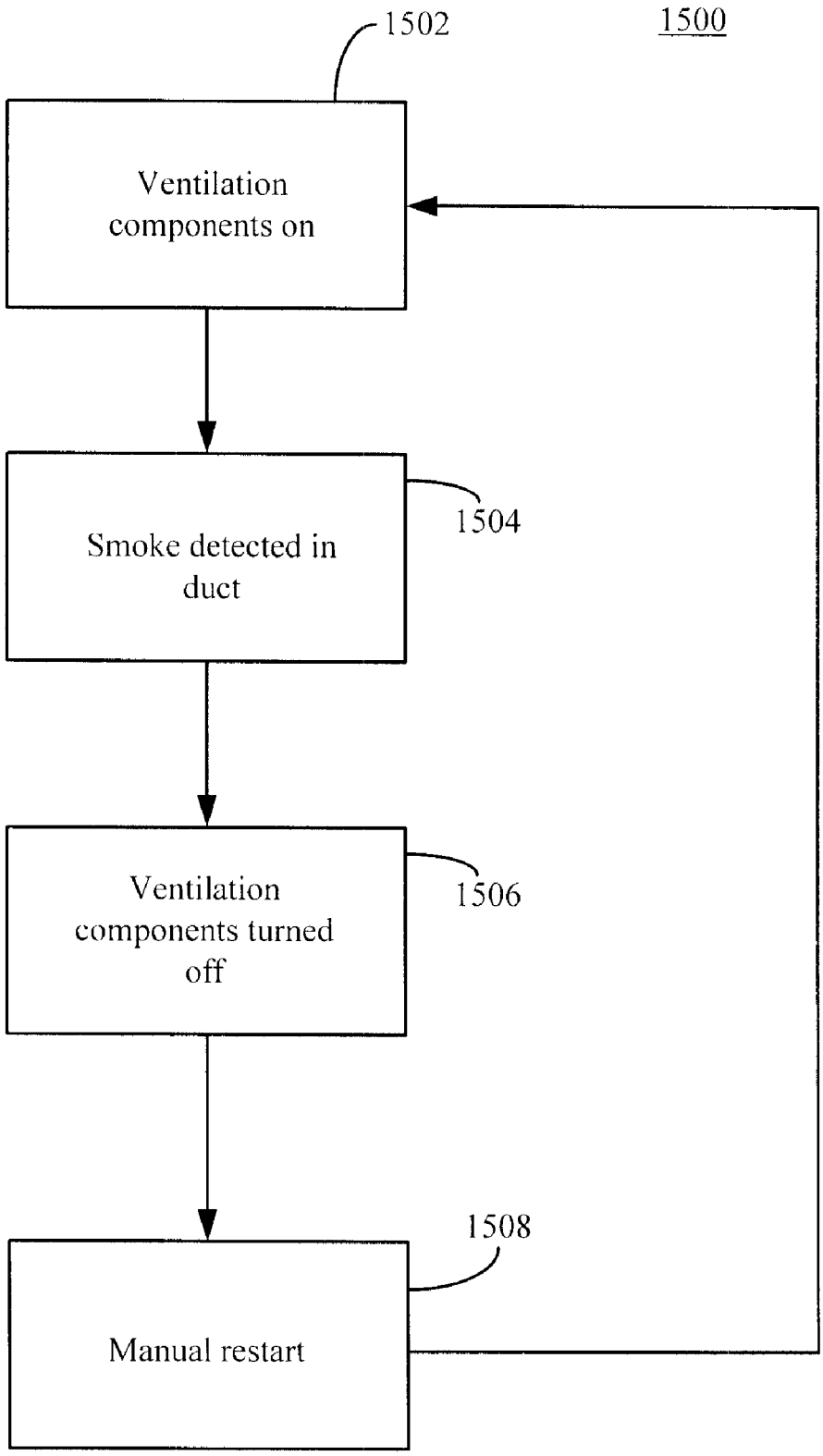
FIG. 15 is a diagram illustrating an exemplary methodology for smoke detection in a ventilation system according to an embodiment of the present invention.

FIG. 15 is a diagram illustrating exemplary methodology 1500 for smoke detection in a ventilation system. In step 1502, the ventilation components, e.g., A/C unit 1202, heating unit 1204 and air distribution fan 1206 (described, for example, in conjunction with the description of FIG. 12, above), are on. In step 1504, smoke is detected in duct 1208 by one or more of the in-line duct smoke detection devices described herein, e.g., smoke detection device 1301 (FIG. 13) or smoke detection device 1401 (FIG. 14). Namely, smoke is present in duct 1208 at, or above, a level that results in a break in the infrared beam, i.e., a break in infrared beam 222 between infrared beam transmitting unit 214 and infrared beam receiving unit 218 (smoke detection device 1301) or a break in infrared beam 620 between light guides 614 and 616 (smoke detection device 1401).

As a result of the infrared beam being broken by the smoke present in duct 1208, a signal is sent to the control module. For example, in the case of smoke detection device 1301, a signal can be sent from infrared beam receiving unit 218 to control module 230. In the case of smoke detection device 1401, a signal can be sent from infrared light module 618 to control module 630.

In step 1506, the control module effectuates the turning off of the ventilation components, e.g. A/C unit 1202, heating unit 1204 and air distribution fan 1206. The control module has to be flipped manually to restart the ventilation components. Thus, in step 1508, the ventilation components are manually restarted.

An optional time delay period, similar to the time delay period described in reference to FIG. 11, above, may be implemented. For example, after smoke is detected in duct 1208 and a signal is sent to the control module, as in step 1504, a time delay period may be instituted before any action is taken in response to the signal. According to an exemplary embodiment, the time delay is for a duration of up to about 120 seconds. Time delays for durations of up to about 90 seconds, up to about 60 seconds, or up to about 30 seconds, can also be similarly employed. After the prescribed time delay period has ended, a determination is then made as to whether there is still smoke present in duct 1208. Namely, after the time delay period has ended, a determination is made as to whether there is still a signal being sent to the control module, i.e., as described in reference to the description of FIG. 11, above. If a signal is still detected, then, as in step 1506, the control module effectuates the turning off of the ventilation components. If no signal is detected, then the ventilation components are permitted to remain on and the time delay period is reset.

The implementation of a time delay period, while optional, is in some instances not applicable. Namely, for many applications, the in-line smoke detection device serves to turn off ventilation components in the event of an emergency situation, e.g., a fire. Thus, an immediate response (without a time delay period) to the detection of smoke would be, in these instances, desirable.

Figure 16:
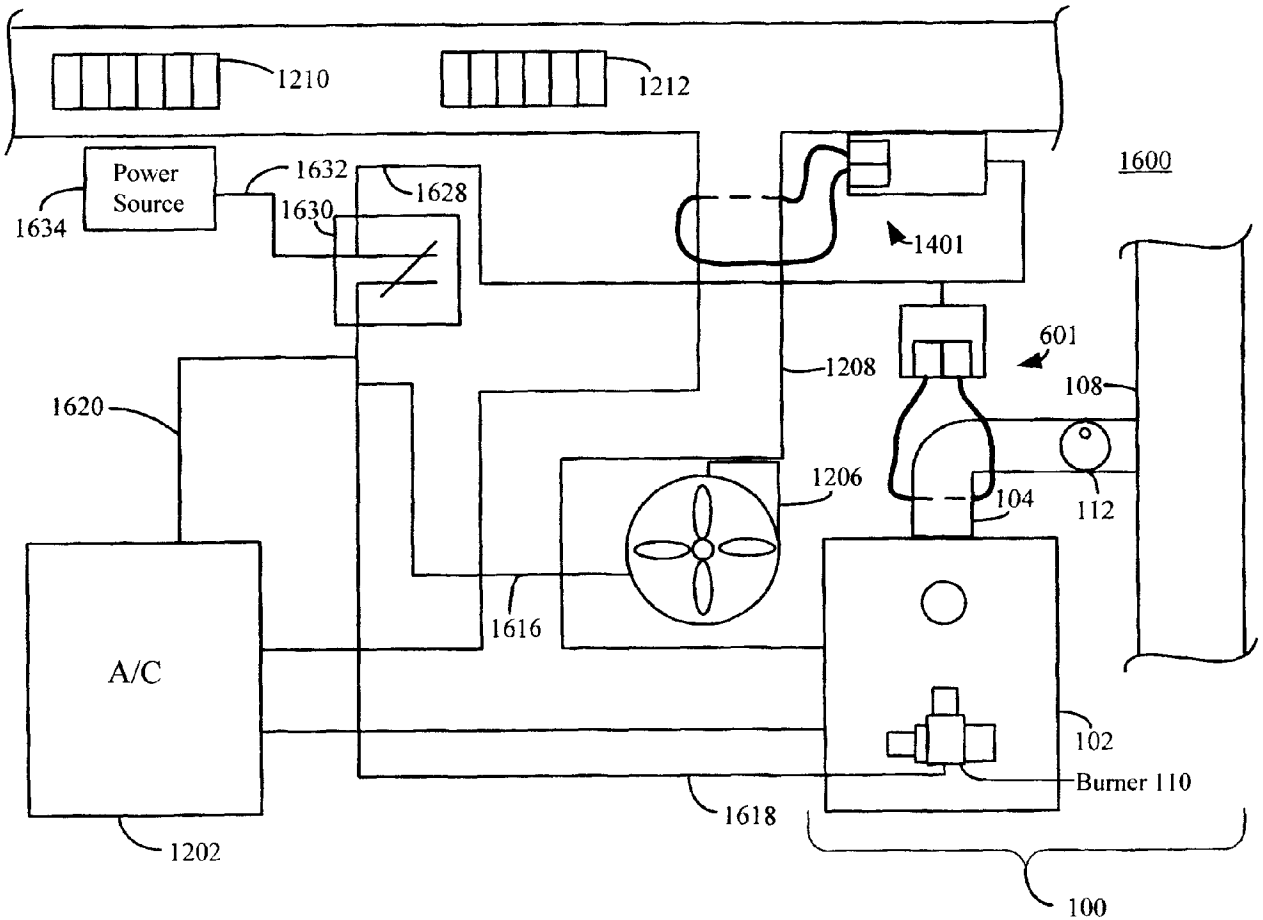
FIG. 16 is a diagram illustrating an exemplary ventilation system having both an in-line duct smoke detection device and a furnace smoke detection device associated therewith according to an embodiment of the present invention.

FIG. 16 is a diagram illustrating exemplary ventilation system 1600. Ventilation system 1600, like ventilation system 1200 (described in conjunction with the description of FIG. 12, above) includes A/C unit 1202, air distribution fan 1206 and duct 1208. The heating unit in ventilation system 1600 is a furnace system, i.e., furnace system 100. As described, for example, in conjunction with the description of FIG. 1, above, furnace system 100 comprises furnace 102, flue 104 and chimney 108.

As is shown in FIG. 16, ventilation system 1600 has both smoke detection device 1401, i.e., an in-line duct smoke detection device, and smoke detection device 601, i.e., a furnace smoke detection device, associated therewith. Specifically, smoke detection device 1401 is associated with duct 1208 and smoke detection device 601 is associated with true 104.

In ventilation system 1600, both smoke detection device 1401 and smoke detection device 601 are connected, i.e., via electrical conduit 1628, to a single control module 1630. Control module 1630 is in turn connected to power source 1634, via electrical conduit 1632. Control module 1630 is also connected to A/C unit 1202, air distribution fan 1206 and burner 110, via electrical conduits 1620, 1616 and 1618, respectively. The relationship between, and the functioning of, a control module, a power source and a smoke detection device have been described in detail above.

Given the configuration shown in FIG. 16, according to one exemplary embodiment, when either one of smoke detection device 1401 or smoke detection device 601 sends a signal to control module 1630, each of A/C unit 1202, air distribution fan 1206 and burner 110 is turned off. Such a set up would cause the entire ventilation system to shut down in the event of, e.g., a malfunctioning burner and/or a fire. Further, each of smoke detection device 1401 and smoke detection device 601 may be set to have the same, or different, sensitivities as one another. For example, according to an embodiment wherein smoke detection device 1401 and smoke detection device 601 have different sensitivities, smoke detection device 1401 may be set to have a greater sensitivity than smoke detection device 601, e.g., so as to accommodate some acceptable level of smoke generated by the furnace during operation.

The ventilation system configuration shown in FIG. 16 is merely exemplary and other configurations are possible. By way of example only, separate control modules may be present, e.g., one control module (linked to A/C unit 1202 and air distribution fan 1206) connected to smoke detection device 1401 and another control module (linked to burner 110) connected to smoke detection device 601. Such a set up would permit smoke detection device 1401 and smoke detection device 601 to operate independently of one another. Thus, for example, a malfunctioning burner might not necessitate shutting down the entire ventilation system, and an independent smoke detection device 601 would permit for only burner 110 being shut off.

Further, the smoke detection devices shown in FIG. 16 are merely exemplary and any of the other smoke detection devices described herein may be similarly employed, in any combination. For example, either of smoke detection device 1301 (described in conjunction with the description of FIG. 13, above) or smoke detection device 1401 may be employed at duct 1208 in combination with either of smoke detection device 201 (described in conjunction with the description of FIG. 2, above) or smoke detection device 601 being employed at flue 104.

Although illustrative embodiments of the present invention have been described herein, it is to be understood that the invention is not limited to those precise embodiments, and that various other changes and modifications may be made by one skilled in the art without departing from the scope of the invention.

What is claimed is:

1. A ventilation system comprising:

a furnace system having a furnace with a burner, a flue positioned to vent smoke from the burner and a bypass that, when activated, is configured to serve as a temporary connection between an ignition mechanism of the burner and an electrical power source;

one or more smoke detection devices, comprising:

an infrared beam transmitting unit;

an infrared beam receiving unit; and a control module associated with the infrared beam transmitting unit and the infrared beam receiving unit, wherein at least one of the one or more smoke detection devices is associated with the flue and is configured to turn off the burner in response to smoke being present in the flue at a level that is greater than a threshold smoke level, wherein the infrared beam transmitting unit and the infrared beam receiving unit are configured to communicate with each other, via an infrared beam produced by the infrared beam transmitting unit, and with the control module, via a signal produced in response to smoke being present at a level that is greater than the threshold smoke level, and wherein the infrared beam transmitting unit is configured to permit adjustment of an intensity of the infrared beam produced thereby so as to permit adjustment of the threshold smoke level.

2. The ventilation system of claim 1, wherein one or more of the smoke detection devices comprises a seal between the flue and at least one of the infrared beam transmitting unit and the infrared beam receiving unit.

3. The ventilation system of claim 1, wherein the flue comprises a barometric damper, and wherein at least one of the one or more smoke detection devices is associated with a portion of the flue that is between the furnace and the barometric damper.

4. The ventilation system of claim 1, wherein at least one of the smoke detection devices associated with the flue further comprises:

a first high-temperature resistant optical fiber having a proximal end attached to the infrared beam transmitting unit and a distal end attached to the flue; and a second high-temperature resistant optical fiber having a proximal end attached to the infrared beam receiving unit and a distal end attached to the flue opposite the distal end of the first high-temperature resistant optical fiber and in line of sight of the distal end of the first high-temperature resistant optical fiber.

5. The ventilation system of claim 4, wherein the at least one smoke detection device further comprises a light guide shield on one or more of the distal end of the first high-temperature resistant optical fiber and the distal end of the second high-temperature resistant optical fiber.

6. The ventilation system of claim 1, further comprising an air conditioning unit, an air distribution fan and a duct connecting one or more of the furnace system, the air conditioning unit and the air distribution fan, and wherein at least one of the one or more smoke detection devices is associated with the duct and is configured to turn off one or more of the heating unit, the air conditioning unit and the air distribution fan in response to smoke being present in the duct at a level that is greater than the threshold smoke level.

* * * * *